US008714311B2

(12) United States Patent
Billger et al.

(10) Patent No.: US 8,714,311 B2
(45) Date of Patent: May 6, 2014

(54) MONOMAST FOR A MATERIALS HANDLING VEHICLE

(75) Inventors: Steven C. Billger, Celina, OH (US); Robert L. Eilerman, Fort Loramie, OH (US); Kevin A. Gilliland, Coldwater, OH (US); Eric J. Hanson, Valparaiso, IN (US); William J. Heidemann, Sidney, OH (US); Robert J. Henshaw, Newnan, GA (US); Jay L. Kuck, St. Marys, OH (US); Jay G. Pollack, Sidney, OH (US); Craig J. Rekow, Troy, OH (US); Adam M. Ruppert, Wapakoneta, OH (US); Lucas B. Waltz, Coldwater, OH (US)

(73) Assignee: Crown Equipment Corporation, New Bremen, OH (US)

( * ) Notice: Subject to any disclaimer, the term of this patent is extended or adjusted under 35 U.S.C. 154(b) by 1089 days.

(21) Appl. No.: 12/557,116

(22) Filed: Sep. 10, 2009

(65) Prior Publication Data

US 2010/0065377 A1 Mar. 18, 2010

Related U.S. Application Data

(60) Provisional application No. 61/096,745, filed on Sep. 12, 2008, provisional application No. 61/096,749, filed on Sep. 12, 2008.

(51) Int. Cl.
*B66F 9/06* (2006.01)
*B66F 9/08* (2006.01)

(52) U.S. Cl.
CPC . *B66F 9/06* (2013.01); *B66F 9/087* (2013.01); *B66F 9/082* (2013.01)
USPC ..... 187/227; 187/230; 414/631; 414/634

(58) Field of Classification Search
CPC ..... B66F 9/075; B66F 9/08; B66F 9/082; B66F 9/087
USPC ..... 187/222, 227, 238, 230; 414/629, 631, 414/540, 619, 634; 280/47.12, 47.25, 280/47.27; 180/23, 24, 211, 252, 253, 180/19.1–19.3; 182/141, 148
IPC ..... B66F 9/075, 9/08, 9/06
See application file for complete search history.

(56) References Cited

U.S. PATENT DOCUMENTS 2,635,711 A * 4/1953 Turner ..... 187/232
2,747,689 A 5/1956 Abbe (Continued)

FOREIGN PATENT DOCUMENTS

CN 2510474 Y 9/2002
DE 1131146 B 6/1962

(Continued)

OTHER PUBLICATIONS

Crown; TSP Series; Turret Stockpicker; SF-12183 Rev. Jan. 2006; Crown Equipment Corporation; New Bremen, OH; 1994-2006.

(Continued)

*Primary Examiner* — William A Rivera
*Assistant Examiner* — Stefan Kruer
(74) *Attorney, Agent, or Firm* — Stevens & Showalter LLP

(57) ABSTRACT

A materials handling vehicle is provided comprising a vehicle power unit having a longitudinal centerline, a monomast coupled to the vehicle power unit and having a centerline offset from and generally parallel with the longitudinal centerline of the vehicle power unit, and a fork carriage apparatus movably coupled to the monomast.

19 Claims, 28 Drawing Sheets

(56) References Cited

U.S. PATENT DOCUMENTS

| | | | | | |
|---|---|---|---|---|---|
| 2,915,144 | A | | 12/1959 | Olson | |
| 2,915,210 | A | | 12/1959 | Ehmann | |
| 2,925,888 | A | | 2/1960 | Kagel | |
| 2,973,878 | A | | 3/1961 | Gibson | |
| 3,035,663 | A | | 5/1962 | Mehlmann | |
| 3,061,045 | A | | 10/1962 | Gunning | |
| 3,082,894 | A | | 3/1963 | Gibson | |
| 3,095,945 | A | | 7/1963 | Mitchell | |
| 3,202,242 | A | | 8/1965 | Dolphin | |
| 3,344,890 | A | | 10/1967 | Loef | |
| 3,372,823 | A | | 3/1968 | Gibson et al. | |
| 3,472,341 | A | | 10/1969 | Stammen | |
| 3,485,323 | A | * | 12/1969 | Ulinski | 187/226 |
| 3,490,633 | A | | 1/1970 | Avis et al. | |
| 3,534,664 | A | | 10/1970 | Ulinski | |
| 3,638,761 | A | | 2/1972 | Ohta | |
| 3,968,859 | A | | 7/1976 | Ehrhardt | |
| 3,970,171 | A | | 7/1976 | Honecker et al. | |
| 3,972,388 | A | | 8/1976 | McVeen | |
| 3,987,870 | A | | 10/1976 | Wojtyna | |
| 3,998,345 | A | | 12/1976 | Fiehler et al. | |
| 3,998,346 | A | | 12/1976 | Gibson et al. | |
| 4,019,786 | A | | 4/1977 | Yarris | |
| 4,051,970 | A | | 10/1977 | Ramsey | |
| 4,084,715 | A | | 4/1978 | Stedman | |
| 4,258,825 | A | * | 3/1981 | Collins | 182/14 |
| 4,354,579 | A | | 10/1982 | Low | |
| 4,355,703 | A | | 10/1982 | Bartow | |
| 4,543,031 | A | | 9/1985 | Luebrecht et al. | |
| 4,552,250 | A | | 11/1985 | Luebrecht | |
| 4,635,757 | A | | 1/1987 | Yamagishi et al. | |
| 4,709,786 | A | | 12/1987 | David et al. | |
| 4,765,441 | A | | 8/1988 | David et al. | |
| 4,848,520 | A | | 7/1989 | Gibel et al. | |
| 4,944,368 | A | | 7/1990 | Duderstadt | |
| 5,022,496 | A | | 6/1991 | Klopfleisch et al. | |
| 5,046,585 | A | * | 9/1991 | Ohta et al. | 187/226 |
| 5,645,142 | A | * | 7/1997 | Kraemer et al. | 187/372 |
| 5,657,834 | A | | 8/1997 | Plaugher et al. | |
| 5,738,187 | A | | 4/1998 | Dammeyer et al. | |
| 5,803,204 | A | * | 9/1998 | White et al. | 182/148 |
| 6,095,286 | A | * | 8/2000 | Citron et al. | 182/148 |
| 6,125,971 | A | * | 10/2000 | Niebuhr et al. | 187/231 |
| 6,135,694 | A | | 10/2000 | Trego et al. | |
| 6,533,076 | B1 | | 3/2003 | Haverfield et al. | |
| 6,851,915 | B2 | | 2/2005 | Warner et al. | |
| 7,096,999 | B2 | | 8/2006 | Lewis et al. | |
| 7,182,369 | B2 | | 2/2007 | Baumann et al. | |
| 2002/0100644 | A1 | * | 8/2002 | Stringer | 187/266 |
| 2006/0060409 | A1 | | 3/2006 | Dammeyer et al. | |
| 2006/0070816 | A1 | * | 4/2006 | Schroder | 187/222 |
| 2007/0080024 | A1 | | 4/2007 | Langenkamp et al. | |

FOREIGN PATENT DOCUMENTS

| | | | | | |
|---|---|---|---|---|---|
| DE | 1257676 | B | | 12/1967 | |
| DE | 10225080 | C1 | * | 12/2003 | B66F 9/08 |
| EP | 0678474 | A2 | | 10/1995 | |
| EP | 1046609 | B1 | | 10/2004 | |
| GB | 944225 | | | 12/1963 | |
| JP | 48033577 | B | | 10/1973 | |
| JP | 52123066 | A | * | 10/1977 | B66F 9/08 |
| JP | S5410783 | | | 5/1979 | |
| JP | H79909 | | | 3/1995 | |
| NL | 1007308 | C2 | | 4/1999 | |

OTHER PUBLICATIONS

Crown; TSP 6000 Series; Turret Order Picker; TSP SPEC GB; Jun. 2006; Crown Gablestapler GmbH & Co. KG; Roding, Germany.

Crown; WAV 50 Series; Work Assist Vehicle; WAVE SPEC GB; Mar. 2005; Crown Gablestapler GmbH & Co., KG; Roding, Germany.

U.S. Appl. No. 12/557,146, filed Sep. 10, 2009, entitled Fork Carriage Apparatus for a Materials Handling Vehicle.

Crown; RR 5200 Series; Reach Truck; VFS-RR5200-01-GB; Jul. 2003; Roding, Germany.

Sheppard, Bruce; International Search Report and Written Opinion of the International Searching Authority; International Application No. PCT/US2009/056534; Dec. 17, 2009; European Patent Office.

Sheppard, Bruce; International Search Report and Written Opinion of the International Searching Authority; International Application No. PCT/US2009/056543; Dec. 8, 2009; European Patent Office.

Ma, Hongjun; Second Office Action Chinese Application No. 200980135436.9; May 24, 2013; State Intellectual Property Office of the People's Republic of China.

Berry Jr, Willie Wendell; Final Office Action; U.S. Appl. No. 12/557,146; Jun. 20, 2013; United States Patent and Trademark Office; Alexandria, VA.

* cited by examiner

MONOMAST FOR A MATERIALS HANDLING VEHICLE

APPLICATION INCORPORATED BY REFERENCE

This application claims the benefit of: U.S. Provisional Application No. 61/096,745, filed Sep. 12, 2008 and entitled "MONOMAST FOR A MATERIALS HANDLING VEHICLE" and U.S. Provisional Application No. 61/096,749, filed Sep. 12, 2008 and entitled "FORK CARRIAGE APPARATUS FOR A MATERIALS HANDLING VEHICLE," the disclosures of which are incorporated by reference herein. This application is also being filed concurrently with U.S. Ser. No. 12/557,146, entitled FORK CARRIAGE APPARATUS FOR A MATERIALS HANDLING VEHICLE, CRN 505 P2A, the entire disclosure of which is incorporated by reference herein.

FIELD OF THE INVENTION

The present invention relates to a materials handling vehicle comprising a monomast and, more particularly, to such a vehicle including a power unit having a longitudinal centerline and wherein the monomast has a centerline offset from and generally parallel to the longitudinal centerline of the vehicle power unit.

BACKGROUND OF THE INVENTION

Japanese Examined Utility Model Publication H7-9909, dated Mar. 8, 1995, discloses a forklift comprising a vehicle body having a centerline Y, a lift member having a centerline X and a lift means having a centerline Z. The lift means is offset to one side of the vehicle body. The lift means centerline Z is disposed at an angle such that the centerline Z intersects with a load center LC of a load on the lift member. Because the lift means is positioned at an angle relative to the vehicle body center line Y, it is believed that the overall length of the vehicle is lengthened in a direction parallel to the vehicle body centerline Y, which is undesirable.

An improved mast for a materials handling vehicle is desired.

SUMMARY OF THE INVENTION

In accordance with a first aspect of the present invention, a materials handling vehicle is provided comprising a vehicle power unit having a longitudinal centerline; a monomast coupled to the vehicle power unit and having a centerline offset from and generally parallel with the longitudinal centerline of the vehicle power unit; and a fork carriage apparatus movably coupled to the monomast.

The monomast may comprise: a first stage weldment coupled to the vehicle power unit; a second stage weldment positioned to telescope over the first stage weldment; a third stage weldment positioned to telescope over the first and second stage weldments; and mast weldment lift structure for effecting lifting movement of the second and third weldments relative to the first stage weldment.

The fork carriage apparatus may be movably coupled to the third stage weldment. The materials handling vehicle may further comprise fork carriage apparatus lift structure for effecting lifting movement of the fork carriage apparatus relative to the third stage weldment.

The fork carriage apparatus lift structure may comprise a first ram/cylinder apparatus comprising a cylinder fixed to the third stage weldment and positioned near the vehicle power unit longitudinal centerline.

The mast weldment lift structure may comprise a second ram/cylinder apparatus comprising a cylinder positioned within and coupled to the first stage weldment.

The first stage weldment may comprise at least one innermost beam member having a first web section extending generally parallel to the monomast centerline and a first thrust roller coupled to the first web section and having an axis of rotation extending generally parallel to the monomast centerline.

The second stage weldment may comprise at least one intermediate beam member having a second web section extending generally parallel to the monomast centerline and a second thrust roller coupled to the second web section and having an axis of rotation extending generally parallel to the monomast centerline. The first thrust roller is capable of engaging the second web section.

The third stage weldment may comprise at least one outermost beam member having a third web section extending generally parallel to the monomast centerline and a third thrust roller coupled to the third web section and having an axis of rotation extending generally parallel to the monomast centerline. The second thrust roller is capable of engaging the third web section. The third thrust roller is capable of engaging the second web section.

The innermost beam member of the first stage weldment may further comprise a first flange section coupled and generally transverse to the first web section. The intermediate beam member of the second stage weldment may further comprise a second flange section coupled and generally transverse to the second web section. The outermost beam member of the third stage weldment may further comprise a third flange section coupled and generally transverse to the third web section.

The first stage weldment may further comprise a first column roller coupled to the first web section of the innermost beam member. The first column roller may have an axis of rotation extending generally transverse to the monomast centerline and be capable of engaging with the second flange section. The second stage weldment may further comprise a second column roller coupled to the second web section of the intermediate beam member. The second column roller may have an axis of rotation extending generally transverse to the monomast centerline and be capable of engaging with the third flange section. The third stage weldment may further comprise a third column roller coupled to the third web section of the outermost beam member. The third column roller may have an axis of rotation extending generally transverse to the monomast centerline and be capable of engaging with the second flange section.

The vehicle power unit may comprise an operator compartment positioned on a side of the longitudinal centerline of the vehicle power unit opposite a side where the monomast is positioned. The at least one outermost beam member of the third stage weldment may comprise first and second outermost beam members. The third stage weldment may further comprise first and second plates extending between and coupled to the first and second outermost beam members. The first plate may have an oblique side wall to expand a field of view of an operator positioned in the operator compartment.

The at least one intermediate beam member of the second stage weldment may comprise first and second intermediate beam members. The second stage weldment may further comprise first and second plates extending between and coupled to the first and second intermediate beam members and two or more pulleys vertically spaced apart from one another and coupled to the first plate of the second stage weldment. The first plate of the second stage weldment may have an oblique side wall.

The at least one innermost beam member of the first stage weldment may comprise first and second innermost beam members. The first stage weldment may further comprise first and second plates extending between and coupled to the first and second innermost beam members. A thickness of at least one of the first and second plates coupled to the first and second innermost beam members may be variable as a function of at least one of a maximum lift height of the third stage weldment and a maximum vehicle load capacity.

In accordance with a second aspect of the present invention, a materials handling vehicle is provided comprising a vehicle power unit having a longitudinal centerline and a monomast coupled to the vehicle power unit. The monomast has a centerline offset from the longitudinal centerline of the vehicle power unit. The monomast comprises a first stage weldment coupled to the vehicle power unit, a second stage weldment positioned to telescope over the first stage weldment, a third stage weldment positioned to telescope over the first and second stage weldments, and mast weldment lift structure for effecting lifting movement of the second and third weldments relative to the first weldment. The vehicle may further comprise a fork carriage apparatus movably coupled to the third stage weldment and a fork carriage apparatus lift structure for effecting lifting movement of the fork carriage apparatus relative to the third stage weldment. The fork carriage apparatus lift structure may comprise a first ram/cylinder apparatus comprising a cylinder positioned near the vehicle power unit longitudinal centerline.

The mast weldment lift structure may comprise a second ram/cylinder apparatus comprising a cylinder positioned within and coupled to the first stage weldment.

In accordance with a third aspect of the present invention, a materials handling vehicle is provided comprising a vehicle power unit having a longitudinal centerline and a monomast coupled to the vehicle power unit. The monomast has a centerline. The monomast comprises a first stage weldment coupled to the vehicle power unit, a second stage weldment positioned to telescope over the first stage weldment, a third stage weldment positioned to telescope over the first and second stage weldments, and mast weldment lift structure for effecting lifting movement of the second and third weldments relative to the first weldment. The vehicle may further comprise a fork carriage apparatus movably coupled to the third stage weldment and fork carriage apparatus lift structure for effecting lifting movement of the fork carriage apparatus relative to the third stage weldment. The fork carriage apparatus lift structure may comprise a first ram/cylinder apparatus comprising a cylinder positioned near the vehicle power unit longitudinal centerline. The second stage weldment may comprise two or more pulleys vertically spaced apart from one another.

Preferably, each of the two or more pulleys comprises an axis of rotation which is generally parallel to the monomast centerline.

DETAILED DESCRIPTION OF THE INVENTION

Figure 1:
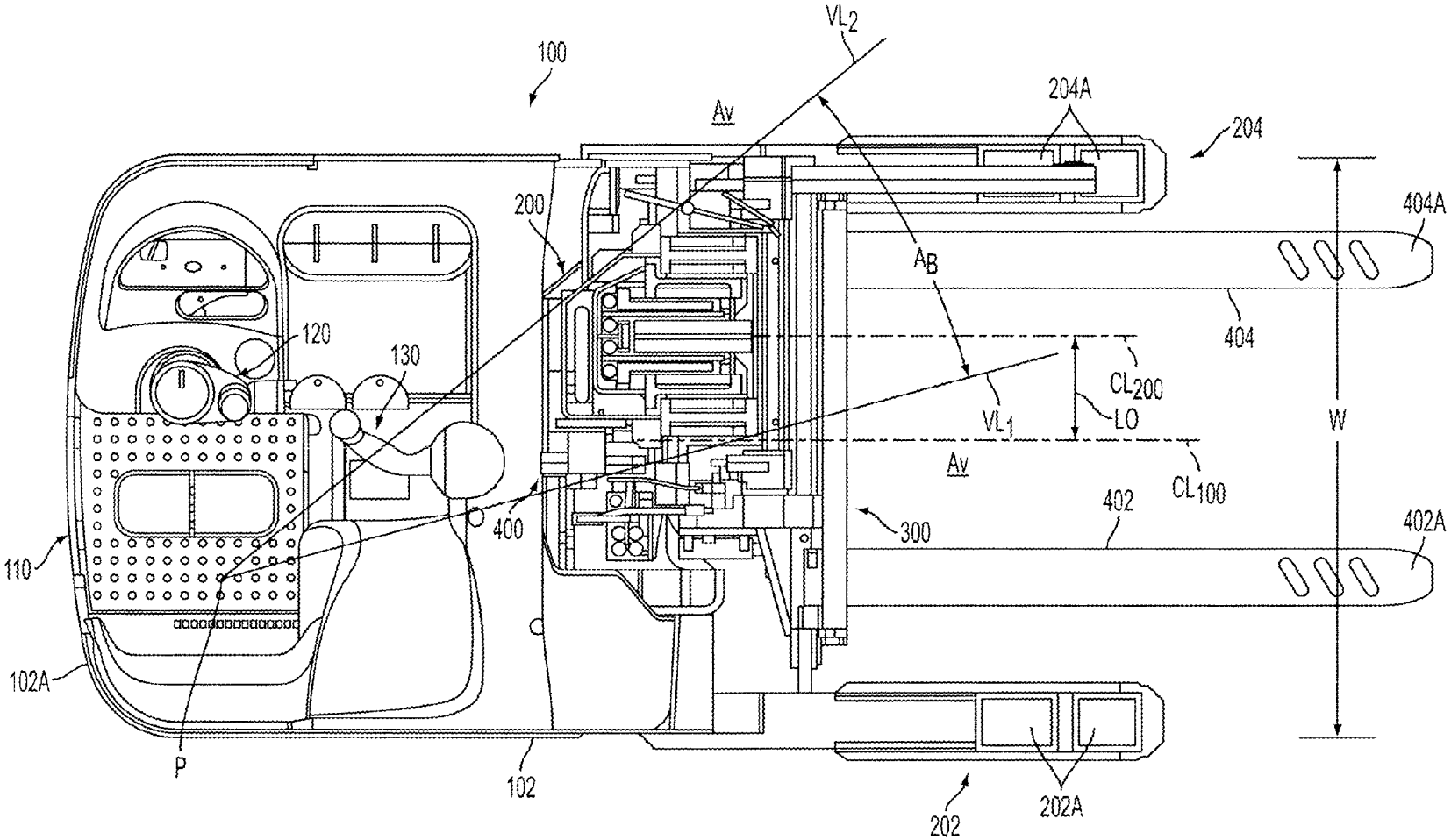
FIG. 1 is a top view of a materials handling vehicle in which a monomast constructed in accordance with the present invention is incorporated.

FIG. 1 illustrates a top view of a rider reach truck 100. A monomast 200, a fork carriage apparatus 300 and a fork carriage apparatus lift structure 400, constructed in accordance with the present invention, are incorporated into the rider reach truck 100, see also FIG. 3. While the present invention is described herein with reference to the rider reach truck 100, it will be apparent to those skilled in the art that the invention and variations of the invention can be more generally applied to a variety of other materials handling vehicles, such as a sit-down counterbalanced truck or a stand-up counterbalanced truck.

Figure 2:
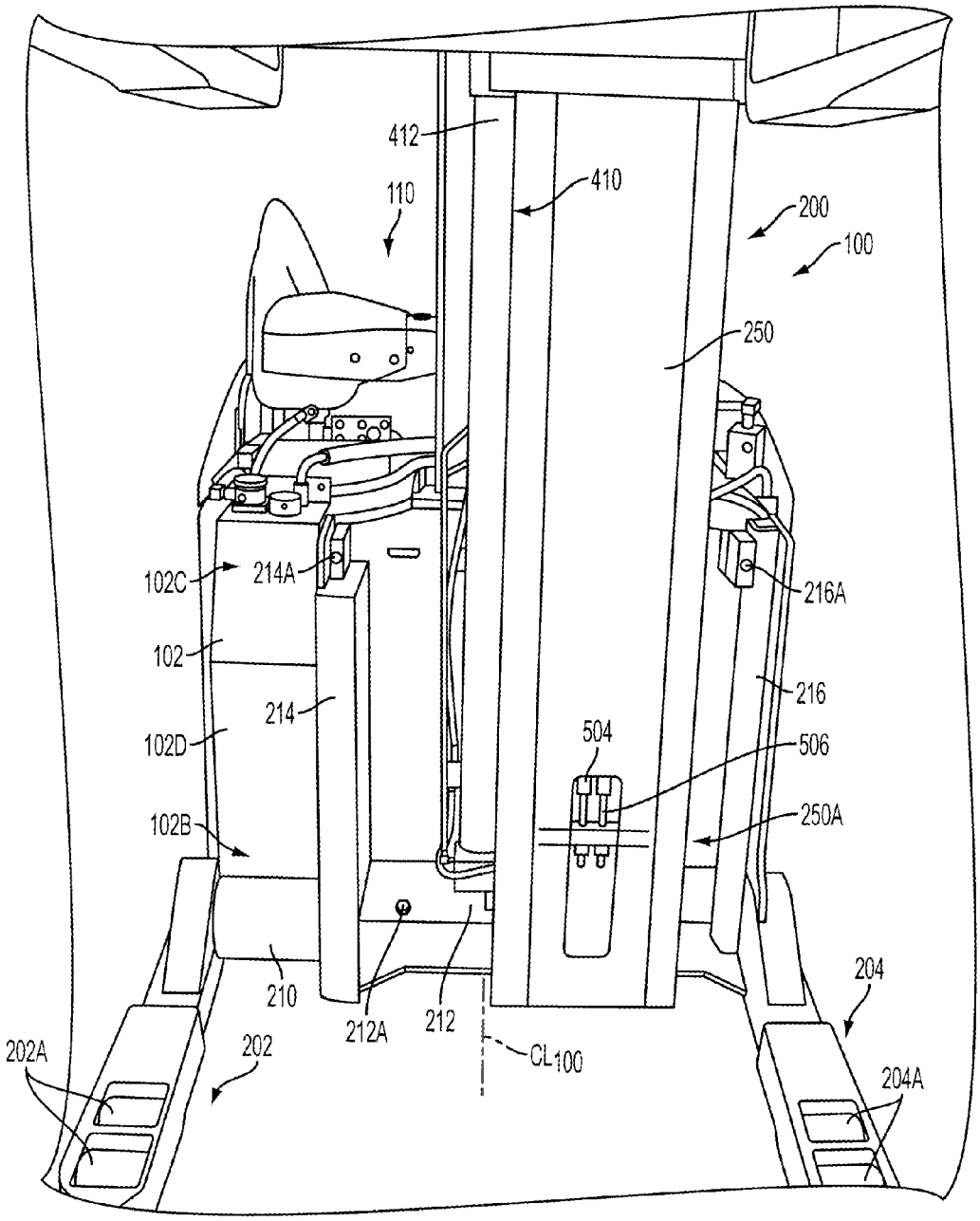
FIG. 2 is a front view of the vehicle illustrated in FIG. 1 with a fork carriage apparatus elevated.

The truck 100 further includes a vehicle power unit 102, see FIGS. 1 and 2, including a longitudinal centerline $CL_{100}$. The power unit 102 houses a battery (not shown) for supplying power to a traction motor coupled to a steerable wheel (not shown) mounted near a first corner at the rear 102A of the power unit 102. Mounted to a second corner at the rear 102A of the power unit 102 is a caster wheel (not shown). A pair of outriggers 202 and 204 are mounted to a monomast frame 210, see FIGS. 2, 4 and 5. The outriggers 202 and 204 are provided with supports wheels 202A and 204A. The battery also supplies power to a motor (not shown), which drives a hydraulic pump (not shown). The pump supplies pressurized hydraulic fluid to the fork carriage apparatus lift structure 400 and a mast weldment lift structure 220.

The vehicle power unit 102 includes an operator's compartment 110, which, in the illustrated embodiment, is positioned on a side of the longitudinal centerline $CL_{100}$ of the vehicle power unit 102 opposite a side where the monomast 200 is positioned, see FIG. 1. An operator standing in the compartment 110 may control the direction of travel of the truck 100 via a tiller 120. The operator may also control the travel speed of the truck 100, and height, extension, tilt and side shift of first and second forks 402 and 404 via a multifunction controller 130, see FIG. 1. The first and second forks 402 and 404 form part of the fork carriage apparatus 300.

The monomast 200 has a longitudinal centerline $CL_{200}$, see FIG. 1. As is apparent from FIG. 1, the monomast longitudinal centerline $CL_{200}$ is offset from, i.e., spaced laterally from, the longitudinal centerline $CL_{100}$ of the vehicle power unit 102. Further, the monomast longitudinal centerline $CL_{200}$ is substantially parallel with the longitudinal centerline $CL_{100}$ of the vehicle power unit 102. Because the monomast longitudinal centerline $CL_{200}$ is not angled or oblique to the longitudinal centerline $CL_{100}$ of the vehicle power unit 102, the overall length of the truck 100 in a direction parallel to the power unit longitudinal centerline $CL_{100}$ is minimized, i.e., made shorter than a truck including a monomast having a longitudinal centerline that is not parallel to a longitudinal centerline of the vehicle power unit. In the illustrated embodiment, the monomast longitudinal centerline $CL_{200}$ is laterally offset approximately 8 inches from the longitudinal centerline $CL_{100}$ of the vehicle power unit 102, see arrow LO in FIG. 1, wherein the vehicle power unit 102 has a width W of about 42 inches. These dimensions can be varied, as will be apparent to one skilled in the art.

In FIG. 1, first and second view lines $VL_1$ and $VL_2$ are shown extending from a point P in the operator's compartment 110, which point P designates the location of the eyes of an average sized operator when positioned in the operator's compartment 110 and driving the vehicle 100. The area between the view lines $VL_1$ and $VL_2$, designated by angle $A_B$, represents an operator viewing area which may be blocked by the monomast 200. However, the areas $A_V$ outside of the view lines $VL_1$ and $VL_2$ are visible to the operator. Hence, an operator, when standing in the operator's compartment 110 in FIG. 1 and looking toward the first and second forks 402 and 404, can clearly view end portions or tips 402A and 404A of the first and second forks 402 and 404 when loading or unloading a pallet (not shown) onto the truck forks 402 and 404 during operation of the truck 100. The operator can also clearly view an area extending from the second fork tip 404A to the right of the first fork 402. This is advantageous when removing a load from or placing a load in a storage rack (not shown) because an operator may see substantially to either side of a load storage location on the rack without any obstacles from the monomast impeding his/her field of vision.

The monomast 200 comprises a first stage weldment 230, a second stage weldment 240 positioned to telescope over the first stage weldment 230 and a third stage weldment 250 positioned to telescope over the first and second stage weldments 230 and 240, see FIGS. 6-10. The monomast 200 further comprises the mast weldment lift structure 220, which effects lifting movement of the second and third stage weldments 230 and 240 relative to the first stage weldment 230, see FIG. 7. As is apparent from FIGS. 2, 3 and 9, the monomast 200 comprises a single structure having a unitary tubular form and does not comprise spaced-apart vertical channels or rails joined by horizontal members wherein an open area is located between the spaced-apart vertical channels or rails.

Figure 4:
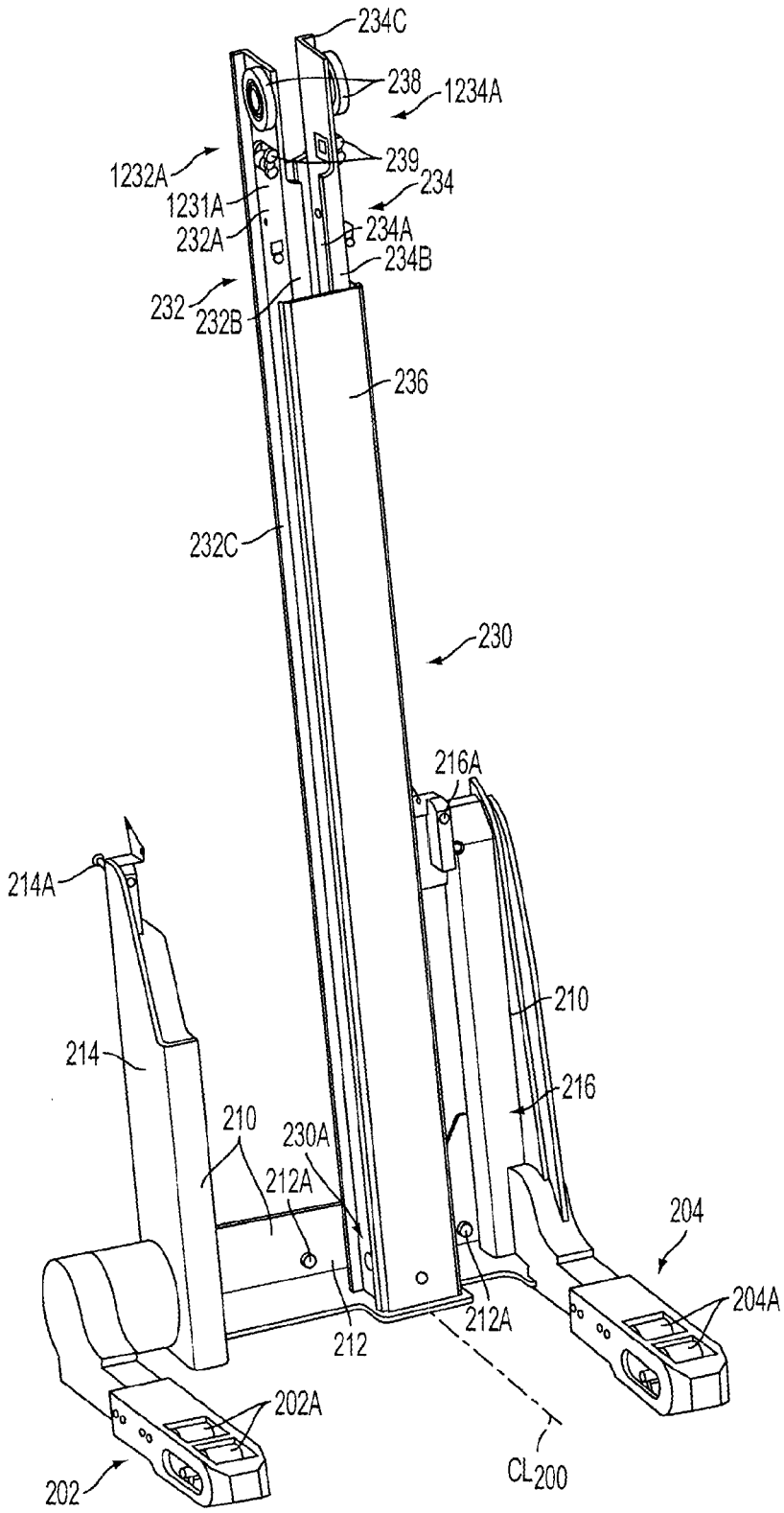
FIG. 4 is a front perspective view of a first stage weldment of the monomast.
Figure 5:
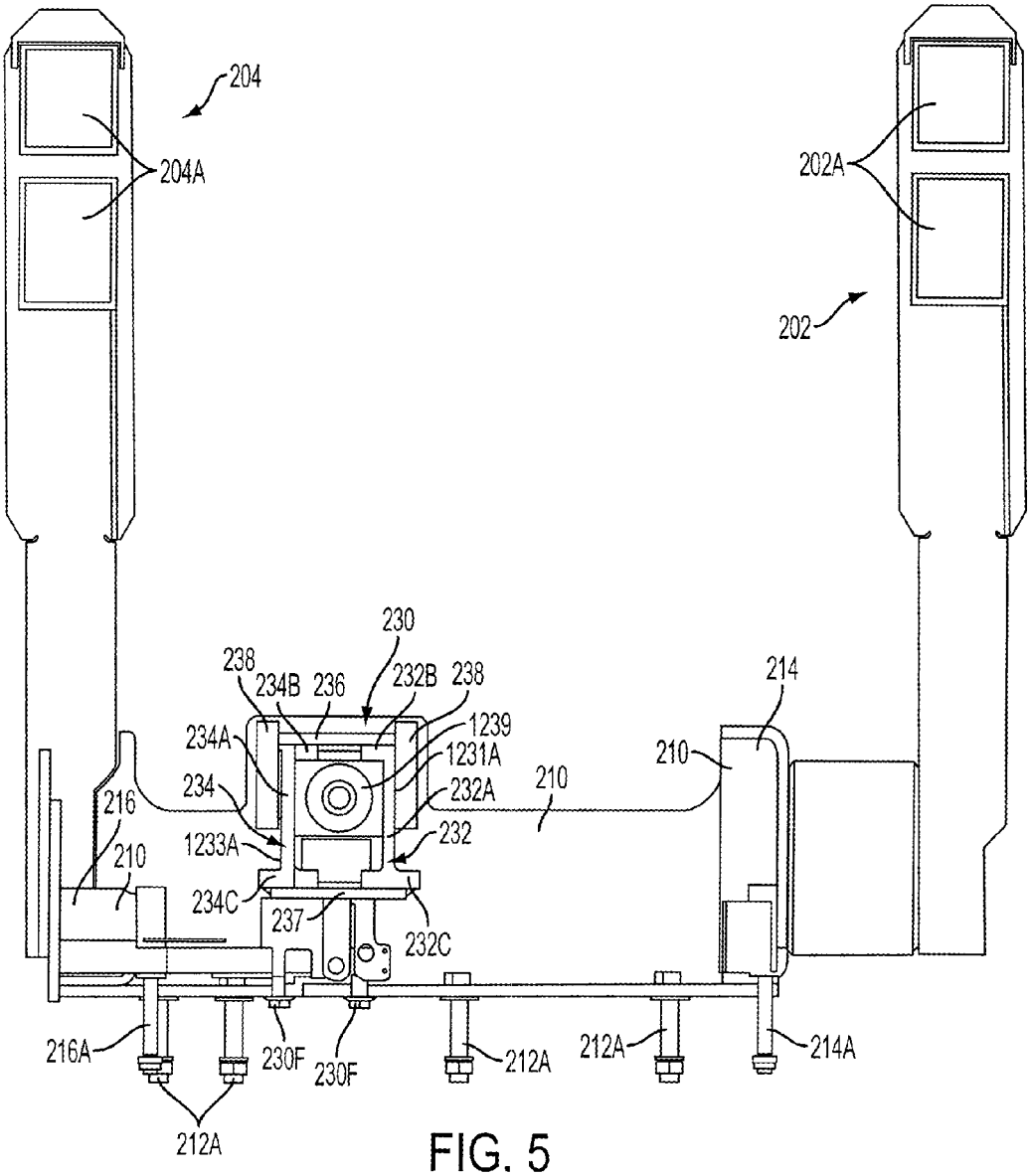
FIG. 5 is a top view of the first stage weldment.

The monomast frame 210 comprises a substantially horizontal base section 212, which is coupled to a lower section 102B of the vehicle power unit 102 via bolts 212A, see FIGS. 2, 4 and 5. A lower section 230A of the first stage weldment 230 is welded to the base section 212 of the monomast frame 210 so as to fixedly couple the first stage weldment 230 to the monomast frame 210. The monomast frame 210 further comprises first and second substantially vertical sections 214 and 216, which are coupled to an upper section 102C of the vehicle power unit 102 via bolts 214A and 216A, see FIGS. 2, 4 and 5.

Figure 20:
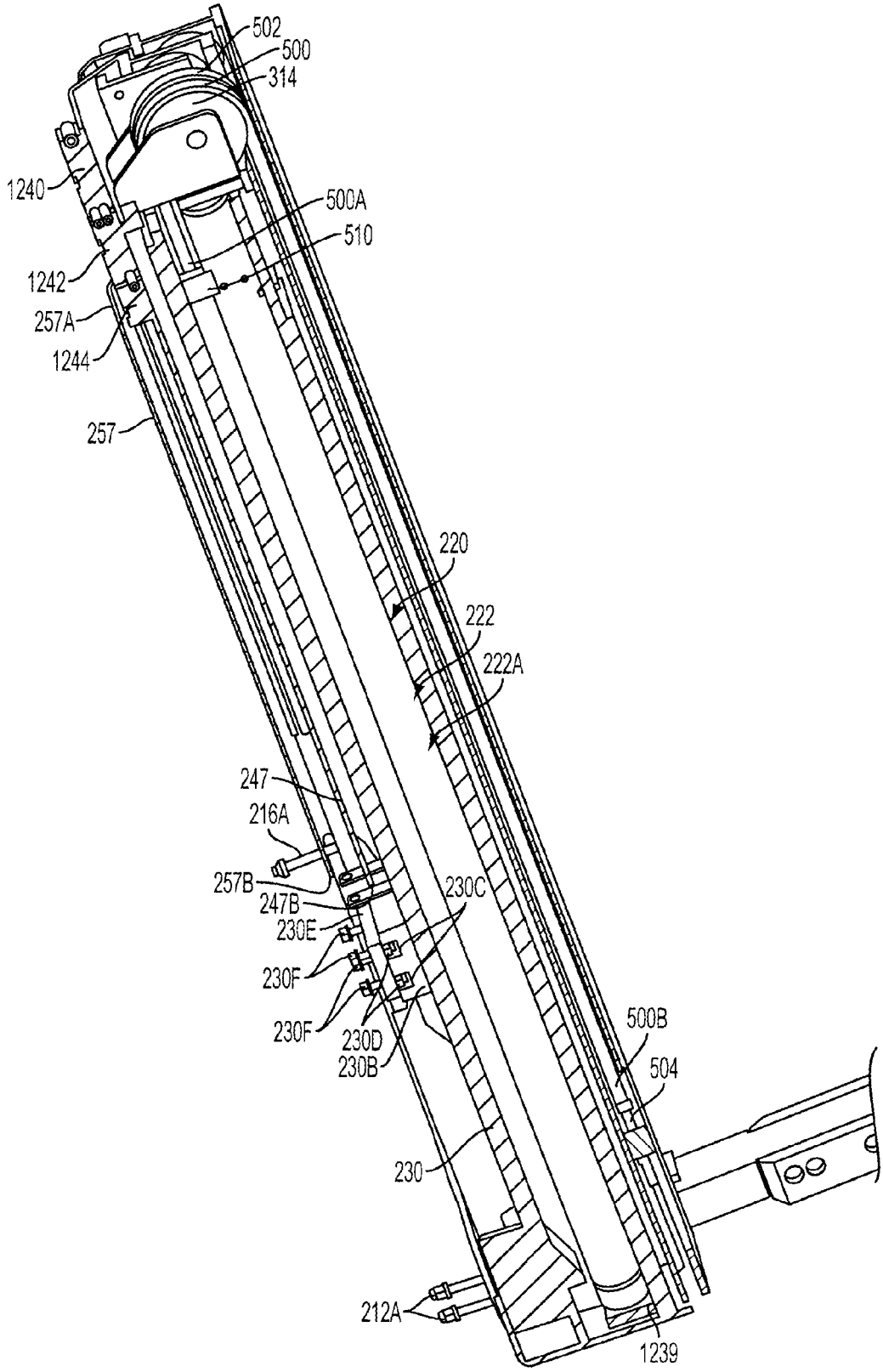
FIG. 20 is a side view, partially in cross section, of the monomast.

A first block 230B is welded to a rear side of the first weldment 230, see FIG. 20. The first block 230B includes a plurality of recesses 230C for receiving nuts 230D, such that the nuts 230D do not rotate in the recesses 230C. A second block 230E is welded to the first block 230B to capture the nuts 230D in the recesses 230C. Four bolts 230F pass through a front wall 102D, see FIG. 2, of the vehicle power unit 102 and corresponding bores (not shown) in the second block 230E, and are threadedly received by the nuts 230D in the first block recesses 230C. The bolts 230F couple the first stage weldment 230 directly to the vehicle power unit 102. Accordingly, the monomast frame 210, the first stage weldment 230 and, hence, the monomast 200, are fixedly coupled or anchored to the vehicle power unit 102 at vertically spaced-apart locations via the bolts 212A, 214A, 216A and 230F.

In the illustrated embodiment, the first stage weldment 230 comprises first and second innermost beam members 232 and 234, see FIGS. 4 and 5. The first innermost beam member 232 comprises a web section 232A and opposing flange sections 232B and 232C formed integral with and transverse to the web section 232A. The second innermost beam member 234 comprises a web section 234A and opposing flange sections 234B and 234C formed integral with and transverse to the web section 234A. The web sections 232A and 234A of the first and second innermost beam members 232 and 234 extend generally parallel to the monomast longitudinal centerline $CL_{200}$, see FIG. 4. A front plate 236 extends between and is coupled to the flange sections 232B and 234B of the first and second innermost beam members 232 and 234, see FIGS. 4 and 5. A rear plate 237 extends between and is coupled to the flange sections 232C and 234C of the first and second innermost beam members 232 and 234. The thickness of one or both of the front and rear plates 236 and 237 may be varied as a function of one or both of a maximum fork lift height and a maximum truck load capacity.

Figure 3:
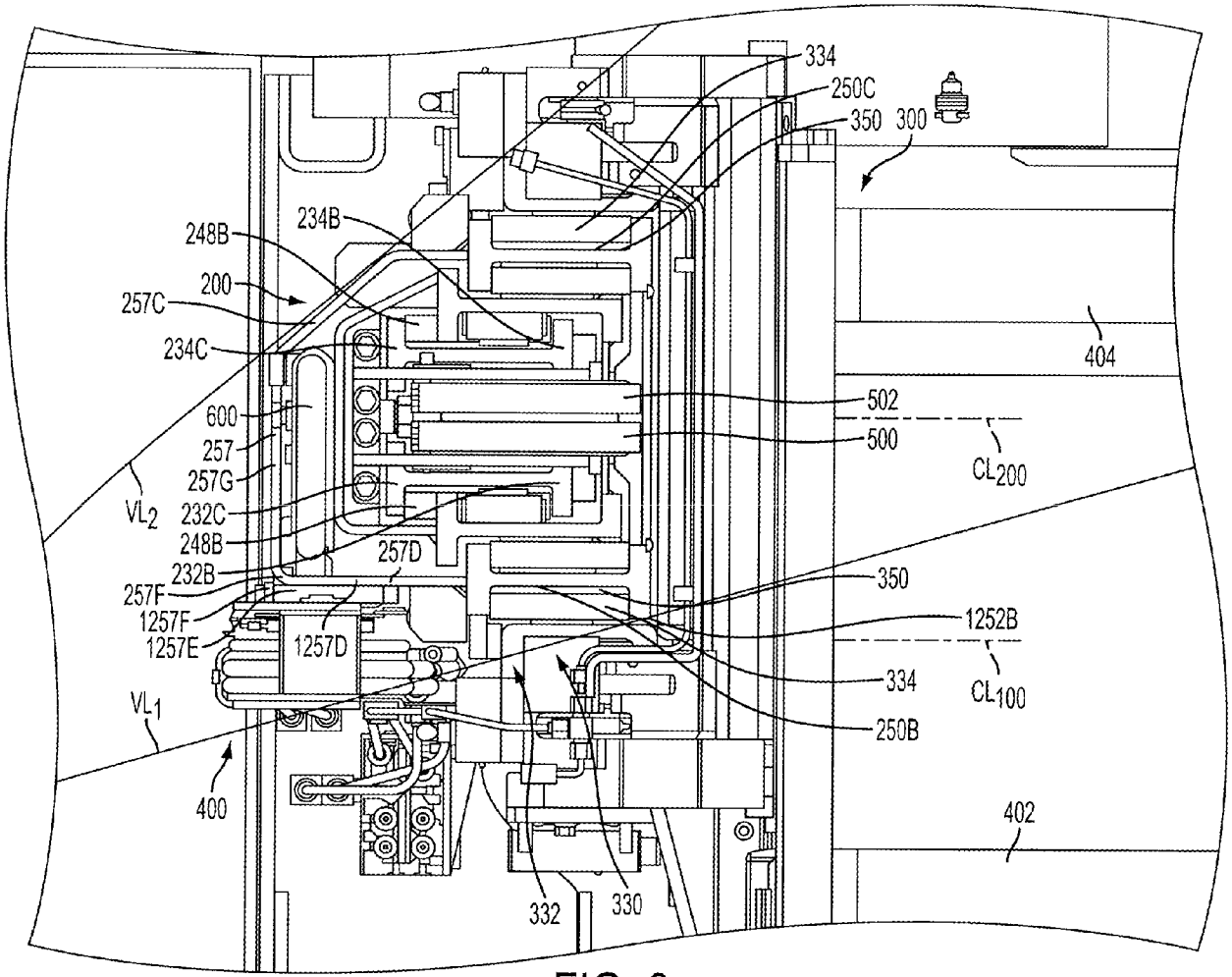
FIG. 3 is an enlarged top view of the monomast illustrated in FIG. 1 with first upper column rollers of the first stage weldment removed.

A first upper column roller 238 is coupled to an outer surface 1231A, 1233A of an upper section 1232A and 1234A of each of the first and second innermost beam members 232 and 234, see FIGS. 4-7 (the column rollers 238 are not illustrated in FIG. 3). The axes of rotation of the first column rollers 238 are generally transverse to the monomast longitudinal centerline $CL_{200}$, see FIG. 4. A first upper thrust roller 239 is coupled to the upper sections 1232A and 1234A of each of the first and second innermost beam members 232 and 234 just below the column rollers 238, see FIGS. 4 and 5. More specifically, the first thrust rollers 239 are coupled to the web sections 232A and 234A of the first and second beam members 232 and 234, see FIG. 7. The thrust rollers 239 extend outwardly beyond the outer surfaces 1231A, 1233A of the upper sections 1232A and 1234A of the first and second beam members 232 and 234, see FIG. 7. Further, the axes of rotation of the first thrust rollers 239 are generally parallel to the monomast longitudinal centerline $CL_{200}$, see FIG. 4.

In the illustrated embodiment, the second stage weldment 240 comprises first and second intermediate beam members 242 and 244, see FIGS. 7 and 11-15. The first intermediate beam member 242 comprises a web section 242A and opposing flange sections 242B and 242C formed integral with and transverse to the web section 242A, see FIG. 11. The second intermediate beam member 244 comprises a web section 244A and opposing flange sections 244B and 244C formed integral with and transverse to the web section 244A, see FIG. 12. The web sections 242A and 244A of the first and second intermediate beam members 242 and 244 extend generally parallel to the monomast longitudinal centerline $CL_{200}$, see FIG. 6. A generally planar front plate 246 extends between and is coupled to the flange sections 242B and 244B of the first and second intermediate beam members 242 and 244, see FIGS. 6 and 11. A rear plate 247 extends between and is coupled to the flange sections 242C and 244C of the first and second intermediate beam members 242 and 244, see FIGS. 6 and 12. In the illustrated embodiment, the rear plate 247 is provided with an oblique side wall 247C, see FIG. 6.

Figure 9:
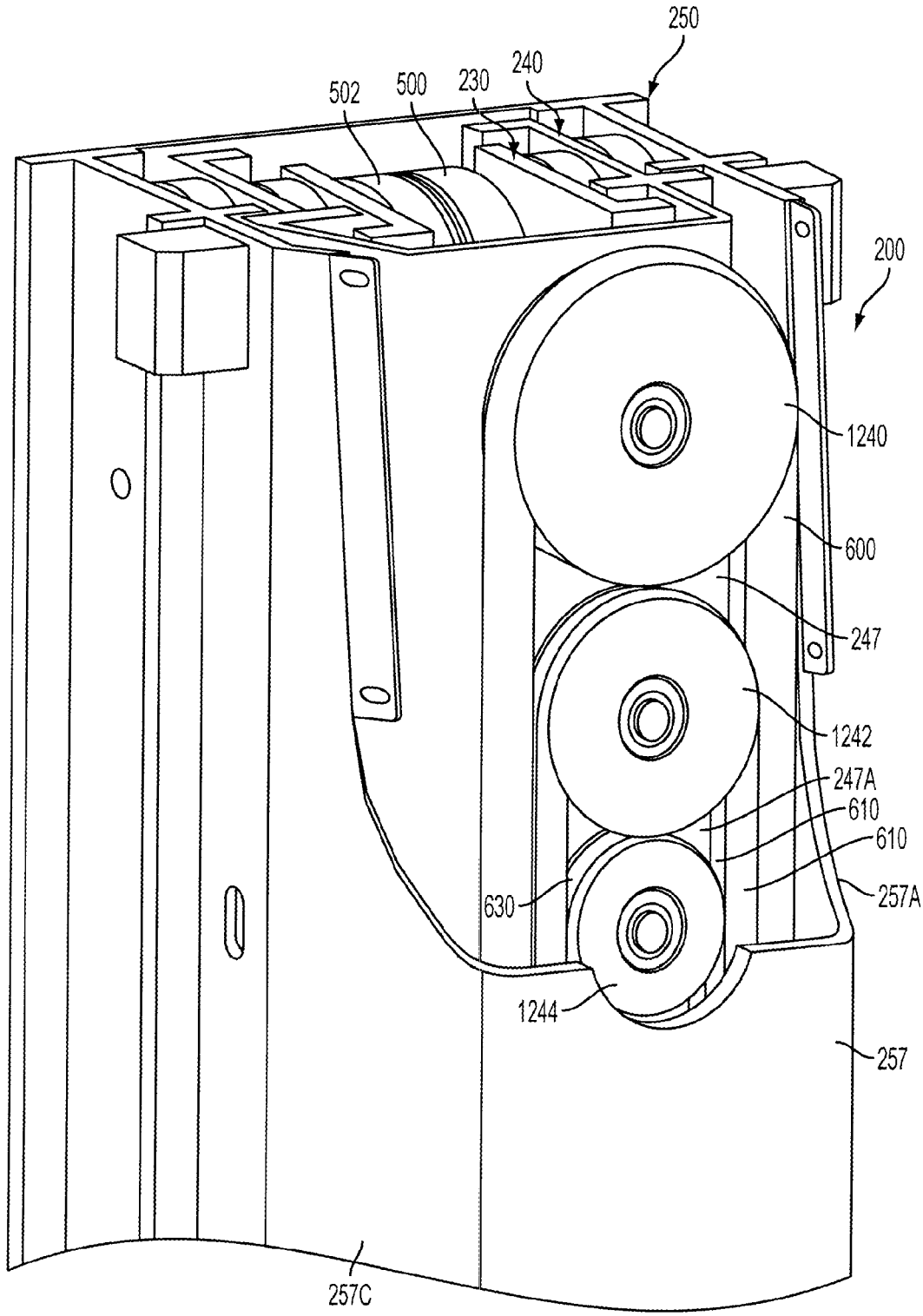
FIG. 9 is a perspective rear view of the upper portion of the monomast.
Figure 12:
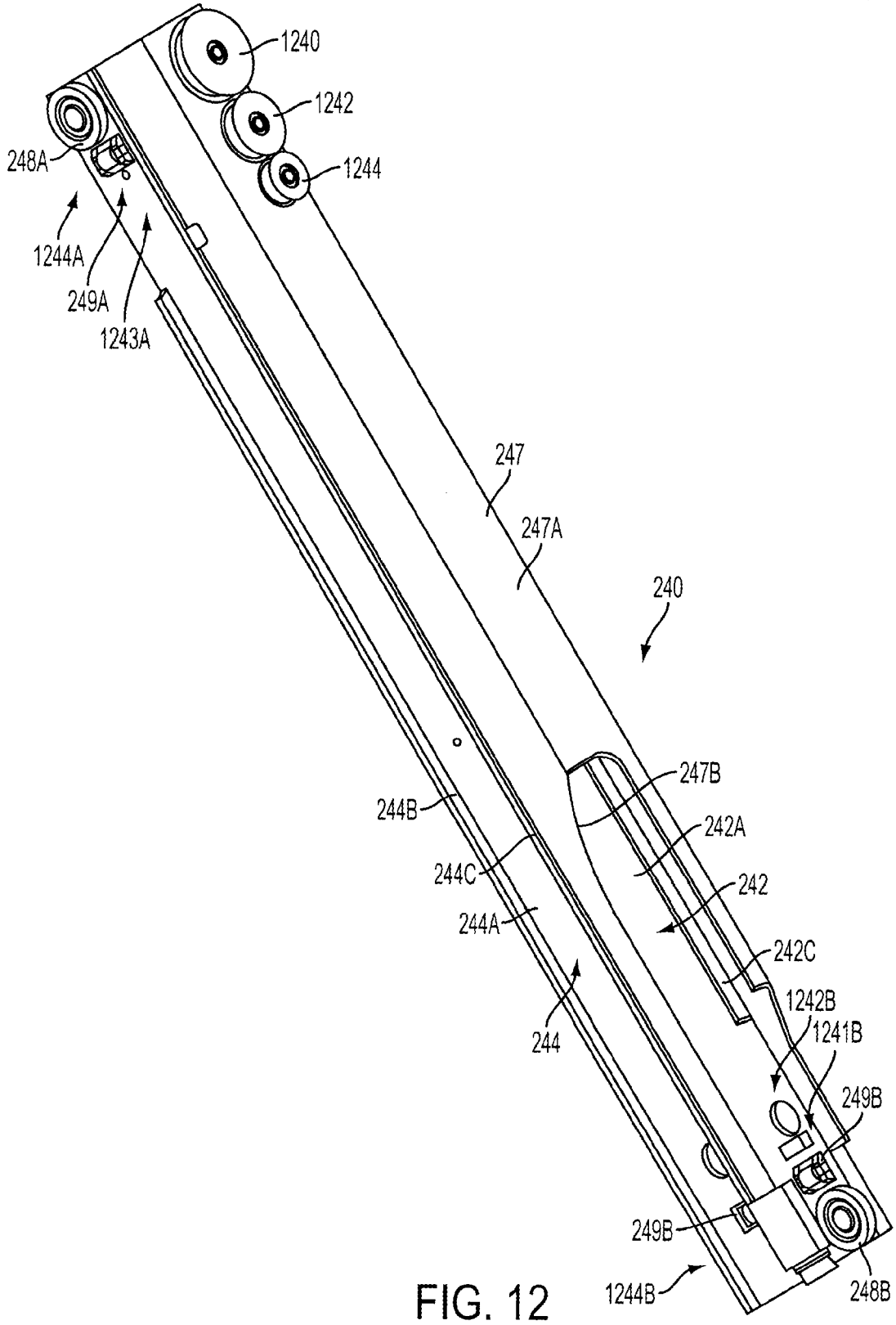
Figure 13:
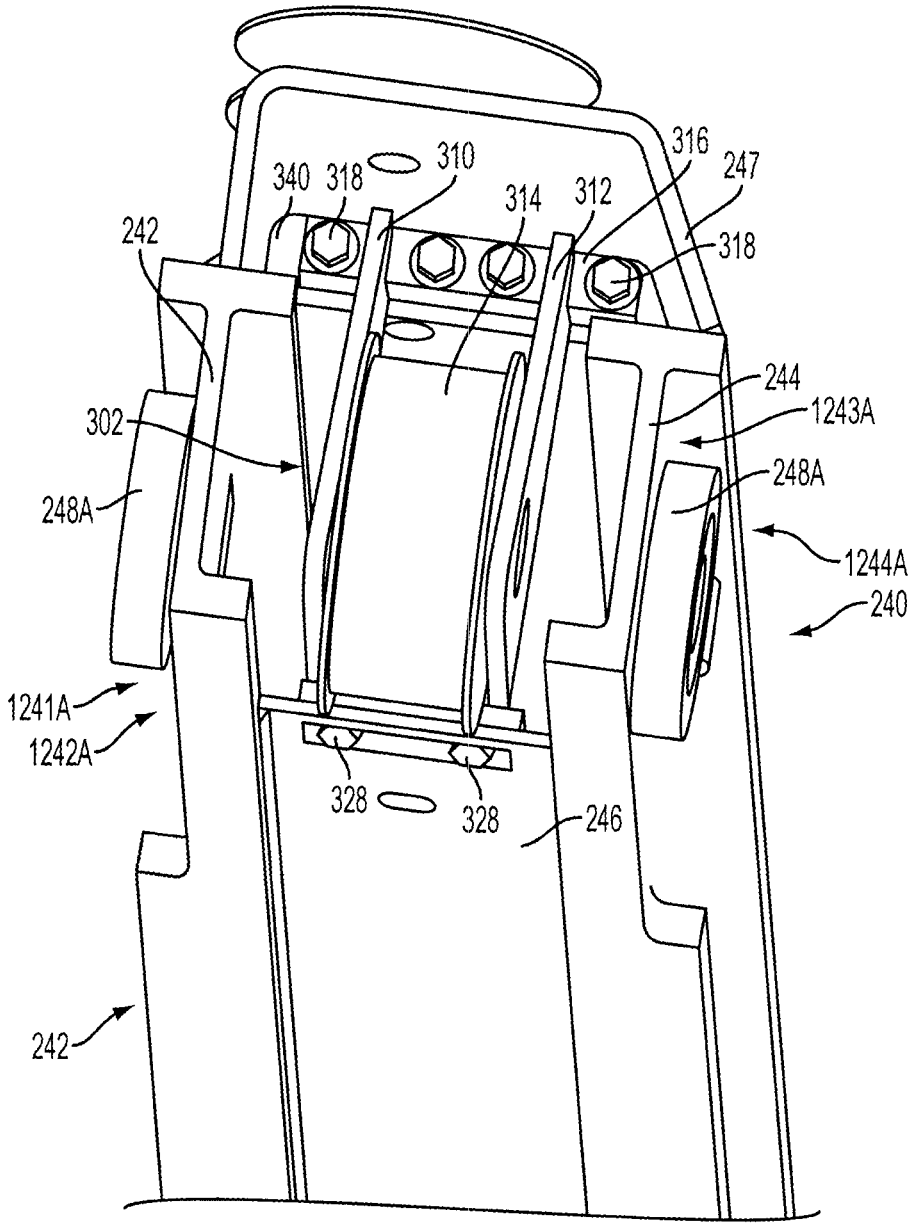
FIGS. 13 and 14 are perspective views of an upper portion of the second stage weldment.
Figure 14:
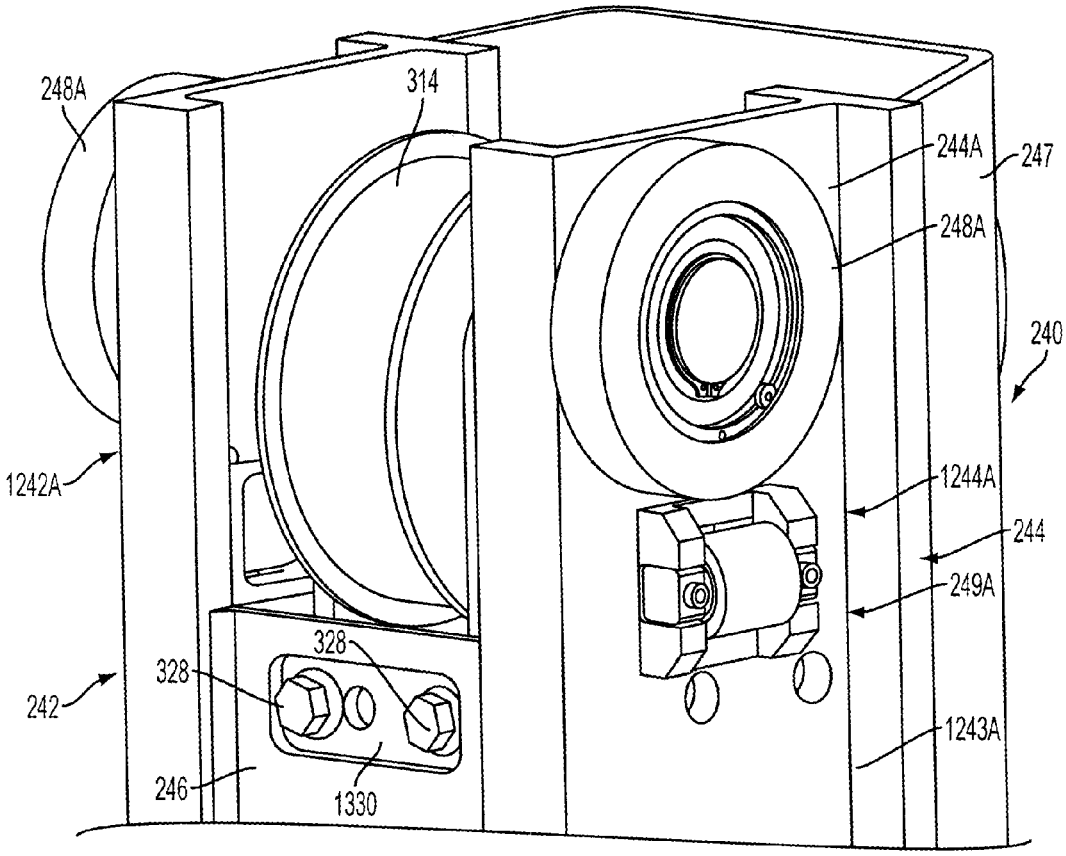
Figure 15:
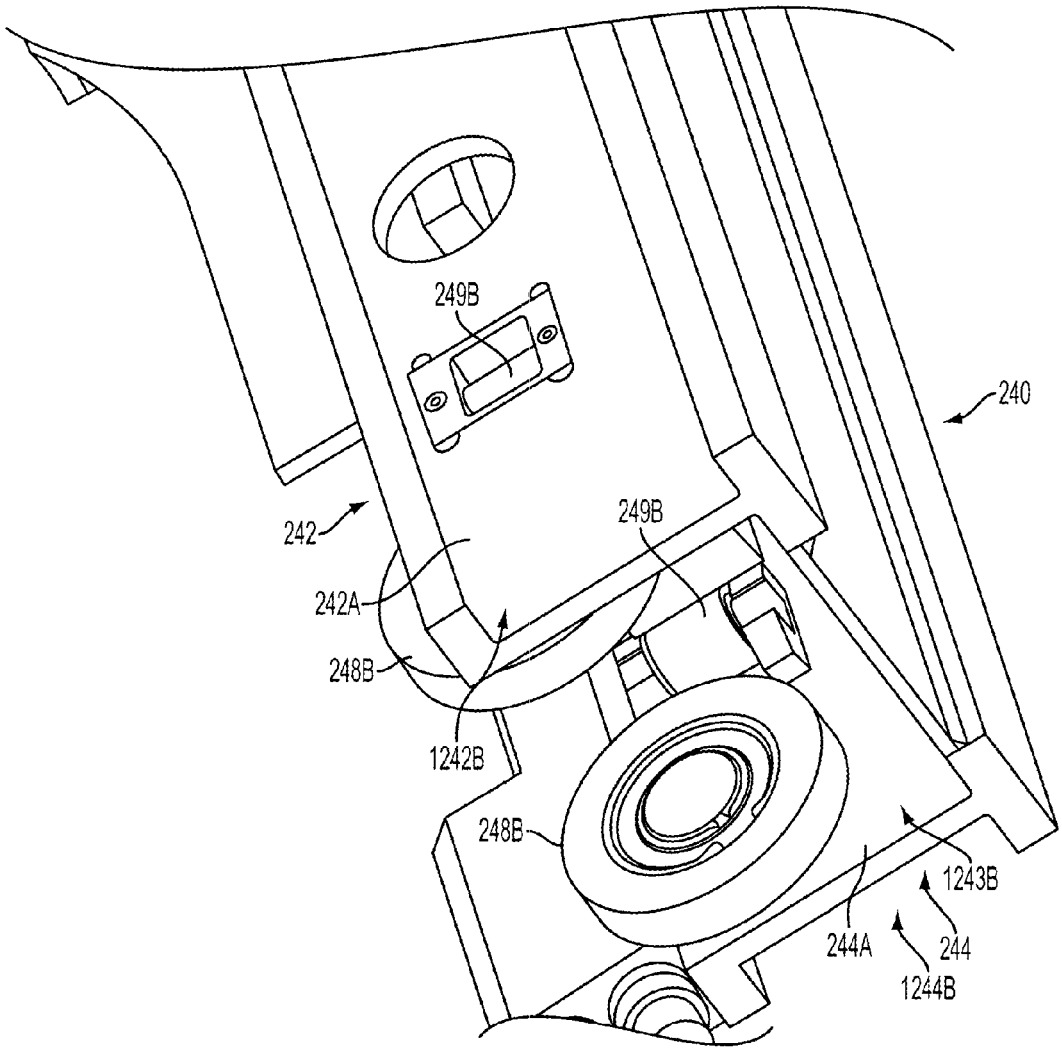
FIG. 15 is a perspective view of a lower portion of the second stage weldment.

First, second and third pulleys 1240, 1242 and 1244 are rotatably coupled to an outer surface 247A of the rear plate 247, see FIGS. 9 and 12. The pulleys 1240, 1242 and 1244 are vertically stacked or aligned in a common vertical plane which allows the size of the monomast 200 to be minimized in a direction parallel to the longitudinal centerline $CL_{200}$ of the monomast 200. As will be discussed further below, hydraulic hoses and electrical cables extend over the pulleys 1240, 1242 and 1244.

The rear plate 247 is formed with a notch 247B, see FIG. 12, which allows the rear plate 247 to avoid making contact with, for example, the bolts 230F and the first and second blocks 230B and 230E coupling the first stage weldment 230 directly to the vehicle power unit 102 when the second stage weldment 240 is in a fully lowered state as illustrated in FIG. 20.

An upper second column roller 248A is rotatably coupled to an outer surface 1241A, 1243A of an upper section 1242A and 1244A of each of the first and second beam members 242 and 244, see FIGS. 6, 11-14. A lower second column roller 248B is coupled to an inner surface 1241B, 1243B of a lower section 1242B and 1244B of each of the first and second beam members 242 and 244, see FIGS. 12 and 15. The axes of rotation of the upper and lower second column rollers 248A and 248B are generally transverse to the monomast longitudinal centerline $CL_{200}$, see FIG. 6.

An upper second thrust roller 249A is coupled to the upper sections 1242A and 1244A of each of the first and second beam members 242 and 244 just below the upper second column rollers 248A, see FIGS. 11 and 12. The upper thrust rollers 249A extend outwardly beyond the outer surfaces 1241A, 1243A of the upper sections 1242A and 1244A of the first and second beam members 242 and 244, see FIGS. 7 and 14. The upper second thrust rollers 249A are coupled to the web sections 242A and 244A of the first and second beam members 242 and 244, see FIGS. 7, 11 and 12. Further, the axes of rotation of the upper second thrust rollers 249A are generally parallel to the monomast longitudinal centerline $CL_{200}$, see FIG. 8.

Figure 11:
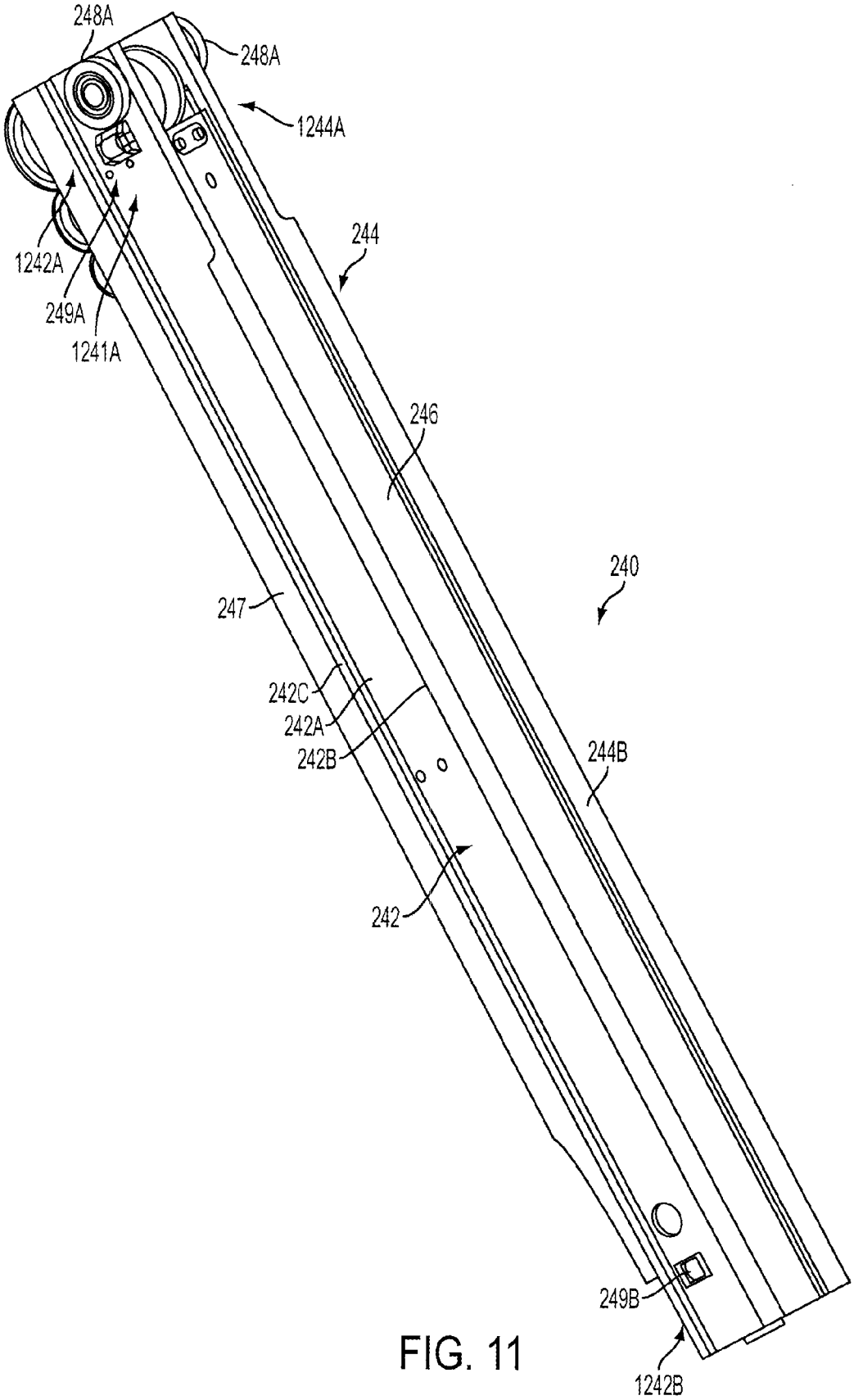
FIGS. 11 and 12 are perspective views of the second stage weldment.

A lower second thrust roller 249B is coupled to the lower sections 1242B and 1244B of each of the first and second beam members 242 and 244 just above the lower second column rollers 248B, see FIGS. 11 and 12. The lower thrust rollers 249B extend inwardly away from the inner surfaces 1241B, 1243B of the lower sections 1242B and 1244B of the first and second beam members 242 and 244, see FIGS. 12 and 15. The lower second thrust rollers 249B are coupled to the web sections 242A and 244A of the first and second beam members 242 and 244, see FIGS. 12 and 15. Further, the axes of rotation of the lower second thrust rollers 249B are generally parallel to the monomast longitudinal centerline $CL_{200}$.

The third stage weldment 250 comprises first and second outermost beam members 252 and 254, see FIGS. 6, 17-19. The first outermost beam member 252 comprises a web section 252A and opposing flange sections 252B and 252C formed integral with and transverse to the web section 252A, see FIG. 17. The second outermost beam member 254 comprises a web section 254A and opposing flange sections 254B and 254C formed integral with and transverse to the web section 254A, see FIG. 19. The web sections 252A and 254A of the first and second outermost beam members 252 and 254 extend generally parallel to the monomast longitudinal centerline $CL_{200}$, see FIG. 6. A front plate 256 extends between and is coupled to the flange sections 252B and 254B of the first and second outermost beam members 252 and 254, see FIGS. 6, 17 and 19. A rear plate 257 extends between and is coupled to the flange sections 252C and 254C of the first and second outermost beam members 252 and 254.

The rear plate 257 is formed with upper and lower notches 257A and 257B, see FIGS. 9, 10, and 17-20. The upper notch 257A allows a technician easy access to the first, second and third pulleys 1240, 1242 and 1244 coupled to the outer surface 247A of the rear plate 247 when they are in need of servicing. The lower notch 257B prevents the rear plate 257 from making contact with, for example, the bolts 230F and the first and second blocks 230B and 230E coupling the first stage weldment 230 directly to the vehicle power unit 102 when the third stage weldment 250 is in a fully lowered state as illustrated in FIG. 20. The rear plate 257 further comprises an oblique side wall 257C to expand a field of view of an operator positioned in the operator compartment, see FIG. 3 where the oblique side wall 257C is shown generally parallel to the view line $VL_2$, see also FIG. 9.

Figure 17:
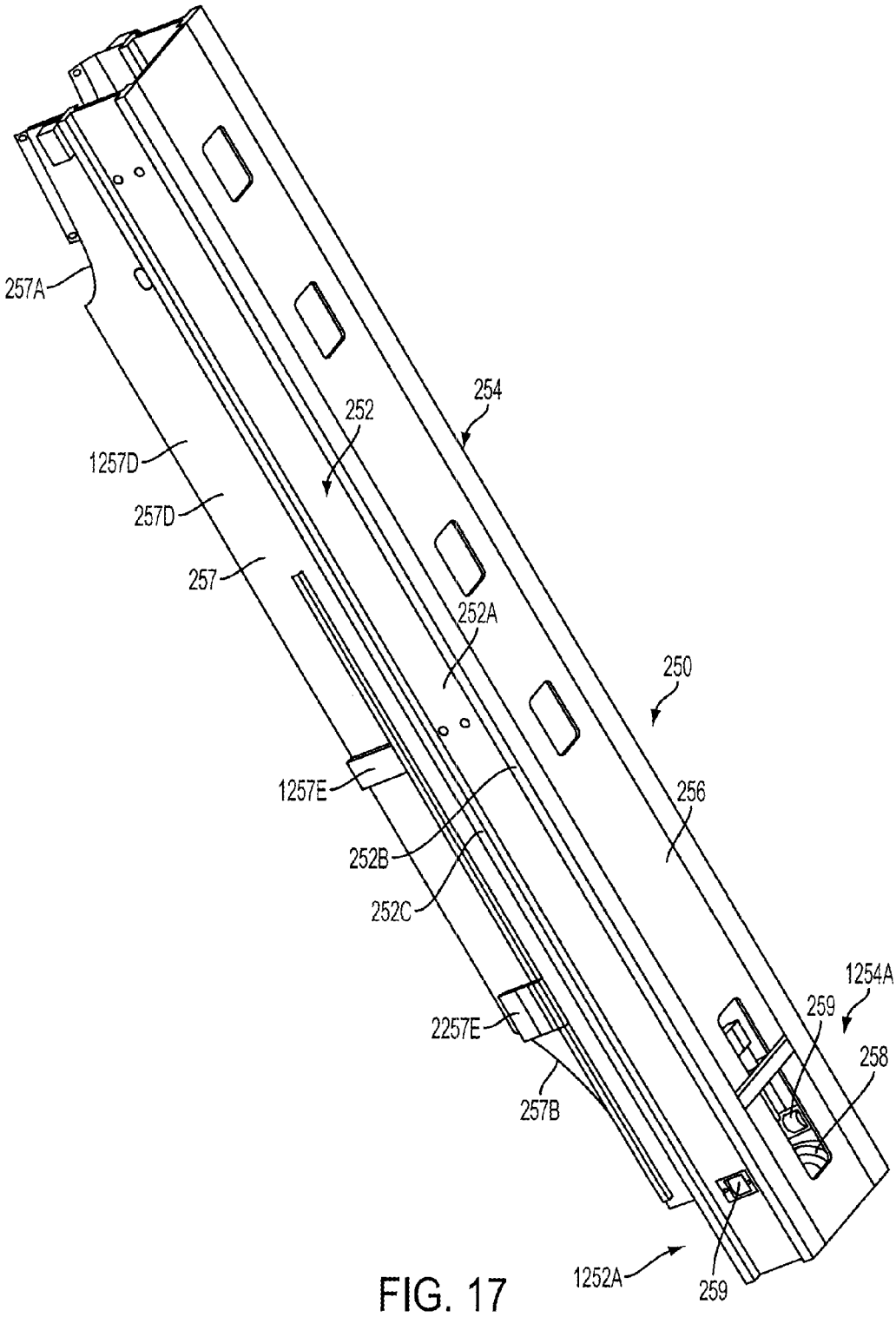
FIG. 17 is a perspective view of a third stage weldment of the monomast.
Figure 18:
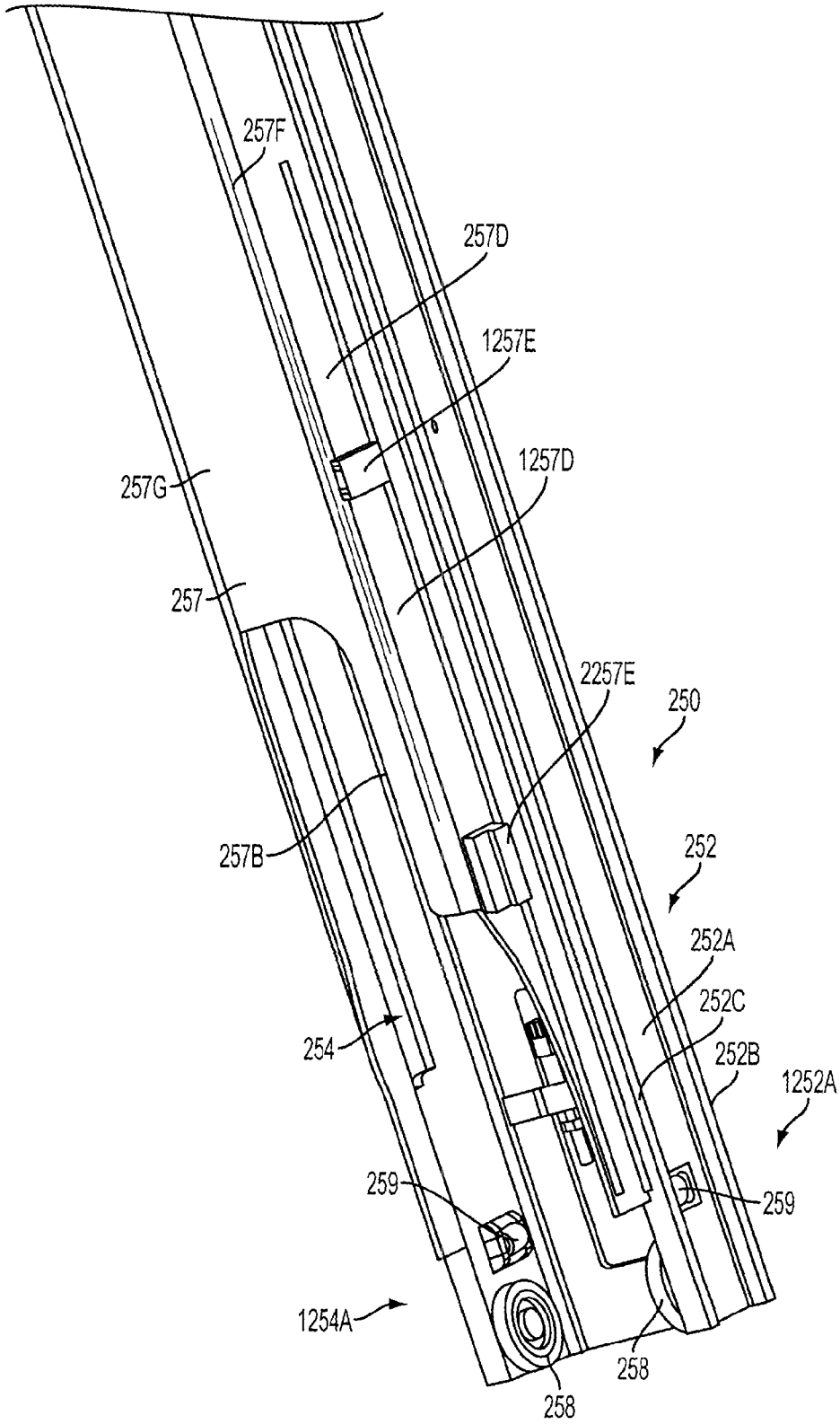
FIG. 18 is a perspective view of a lower portion of the third stage weldment.
Figure 19:
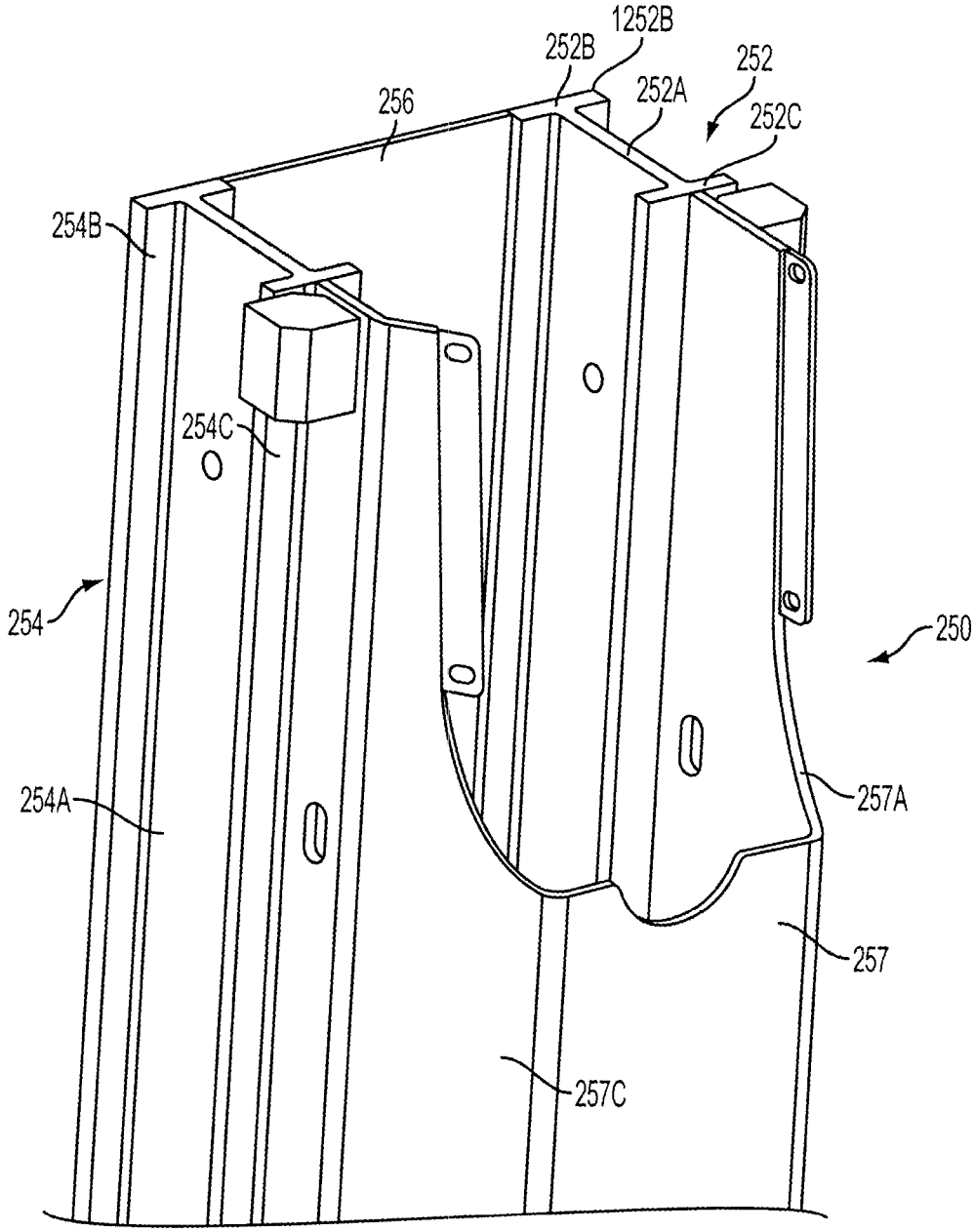
FIG. 19 is a perspective view of an upper portion of the third stage weldment.
Figure 21:
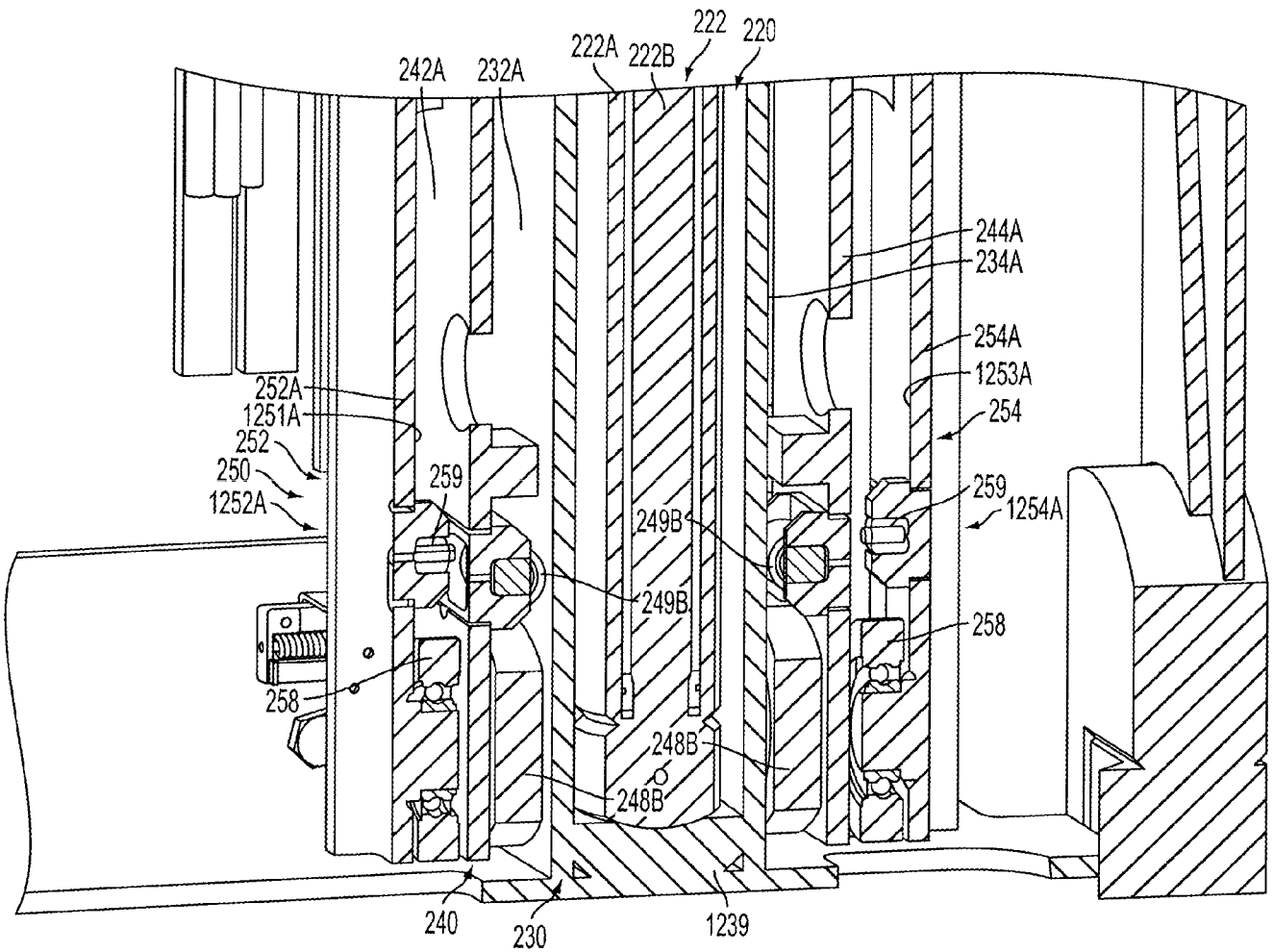
FIG. 21 is a side view, partially in cross section, of a lower portion of the monomast.

A lower column roller 258 is coupled to an inner surface 1251A, 1253A of a lower section 1252A and 1254A of each of the first and second outermost beam members 252 and 254, see FIGS. 17, 18 and 21. The axes of rotation of the lower column rollers 258 are generally transverse to the monomast longitudinal centerline $CL_{200}$. A lower thrust roller 259 is coupled to the lower sections 1252A and 1254A of each of the first and second outermost beam members 252 and 254 just above the column rollers 258, see FIGS. 17, 18 and 21. Only a shaft of each thrust roller 259 and a corresponding bracket supporting the shaft can be seen in FIG. 21. More specifically, the thrust rollers 259 are coupled to the web sections 252A and 254A of the first and second beam members 252 and 254. The lower thrust rollers 259 extend inwardly away from the inner surfaces 1251A, 1253A of the lower sections 1252A and 1254A of the first and second beam members 252 and 254, see FIG. 21. Further, the axes of rotation of the thrust rollers 259 are generally parallel to the monomast longitudinal centerline $CL_{200}$.

Figure 6:
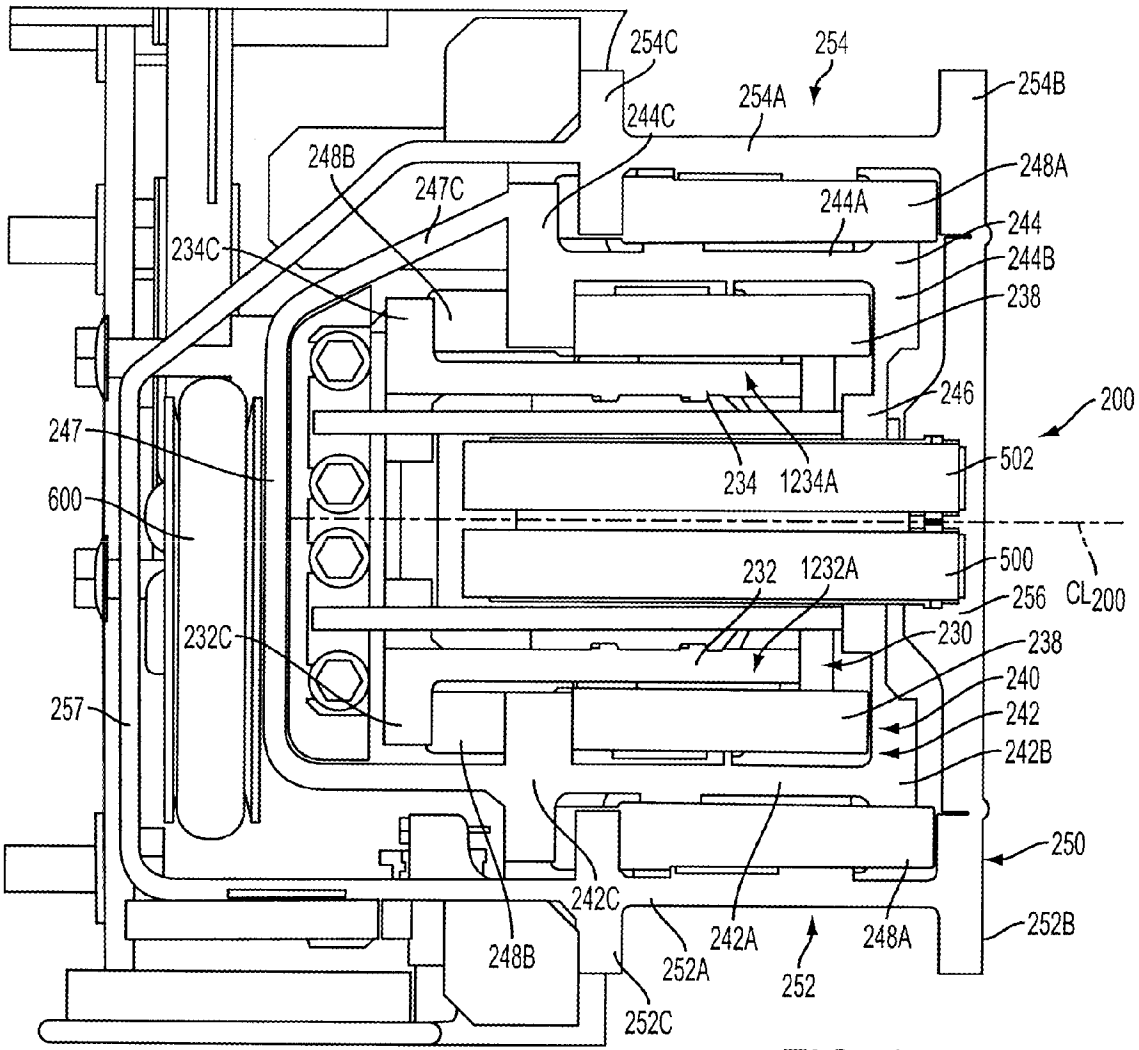
FIG. 6 is a top view of the monomast.

The first upper column roller 238 coupled to the upper section 1232A of the first innermost beam member 232 is positioned between and capable of engaging the opposing flange sections 242B and 242C of the first intermediate beam member 242 of the second stage weldment 240, see FIG. 6. The first upper column roller 238 coupled to the upper section 1234A of the second innermost beam member 234 is positioned between and capable of engaging the opposing flange sections 244B and 244C of the second intermediate beam member 244 of the second stage weldment 240, see FIG. 6. The lower second column roller 248B coupled to the inner surface 1241B of the lower section 1242B of the first intermediate beam member 242 is positioned between and capable of engaging the opposing flange sections 232B and 232C of the first innermost beam member 232 of the first stage weldment 230, see FIG. 6. The lower second column roller 248B coupled to the inner surface 1243B of the lower section 1244B of the second intermediate beam member 244 is positioned between and capable of engaging the opposing flange sections 234B and 234C of the second innermost beam member 234 of the first stage weldment 230, see FIG. 6.

As the second stage weldment 240 moves relative to the fixed first stage weldment 230, the second stage weldment 240 is maintained in proper position relative to the first stage weldment 230 in a direction substantially parallel to the longitudinal centerline $CL_{100}$ of the vehicle power unit 102 by the flange sections 242B, 242C and 244B, 244C of the first and second intermediate beam members 242, 244 engaging the first upper column rollers 238 on the first stage weldment 230, and the lower second column rollers 248B on the second stage weldment 240 engaging the flange sections 232B, 232C and 234B, 234C of the first and second innermost beam members 232, 234, see FIGS. 3 and 6. The flange sections 242B, 242C and 244B, 244C of the first and second intermediate beam members 242, 244 further function to transfer forces extending in a direction substantially parallel to the longitudinal centerline $CL_{100}$ of the vehicle power unit 102 from the second stage weldment 240 to the column rollers 238 on the first stage weldment 230, while the lower second column rollers 248B further function to transfer forces extending in a direction substantially parallel to the longitudinal centerline $CL_{100}$ of the vehicle power unit 102 from the second stage weldment 240 to the flange sections 232B, 232C and 234B, 234C on the first stage weldment 230.

Figure 7:
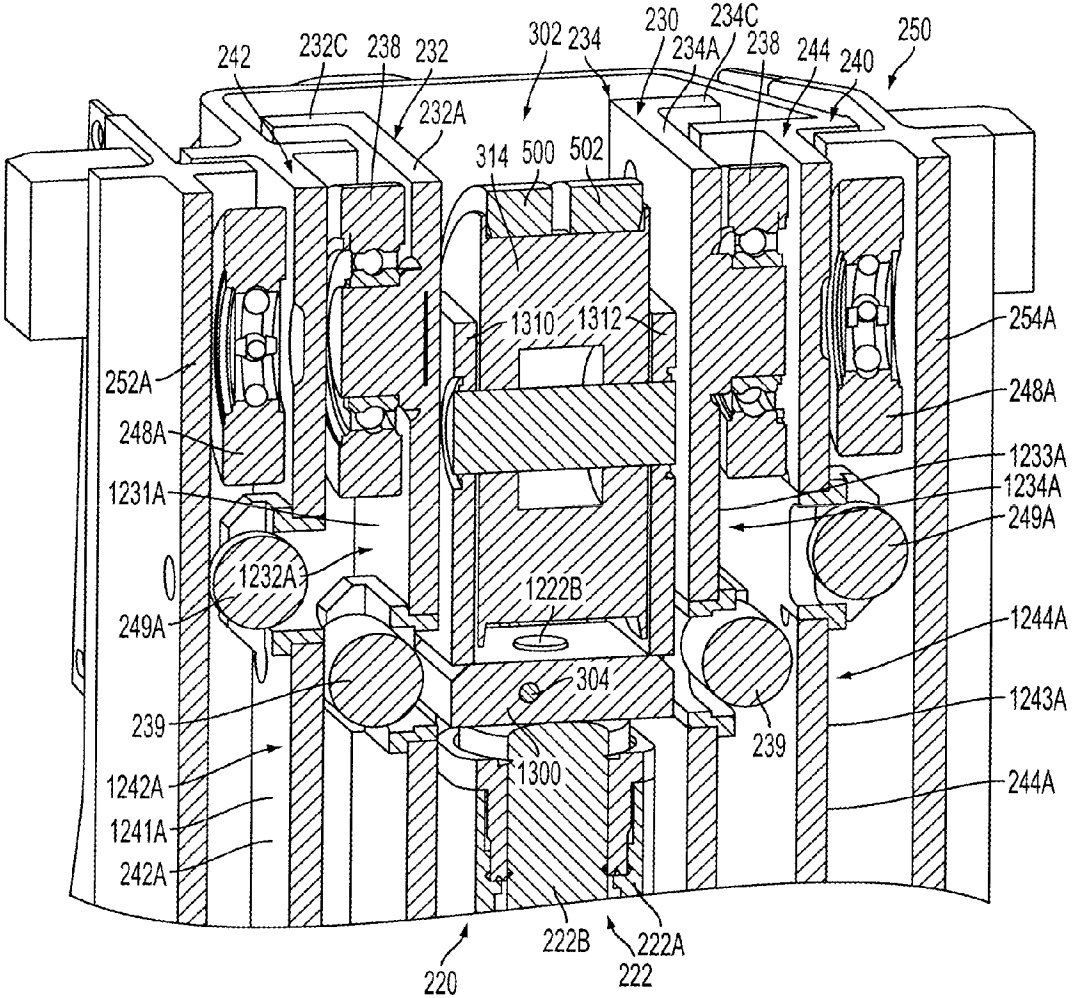
FIG. 7 is a side view, partially in cross section, of an upper portion of the monomast.
Figure 8:
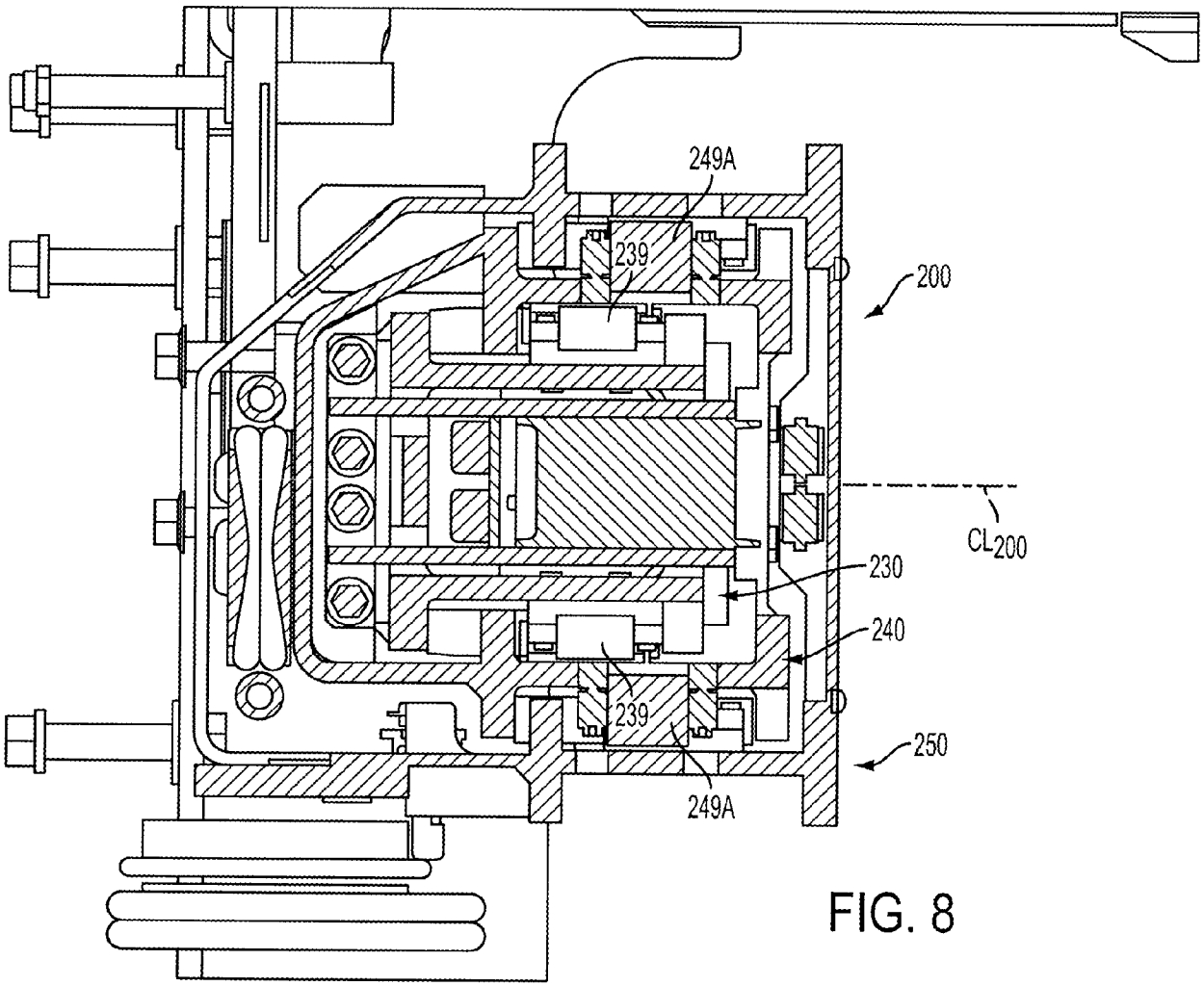
FIG. 8 is a top view, partially in cross section, of the monomast.

Also as the second stage weldment 240 moves relative to the fixed first stage weldment 230, the second stage weldment 240 is maintained in proper position relative to the first stage weldment 230 in a direction substantially perpendicular to the longitudinal centerline $CL_{100}$ of the vehicle power unit 102 by the web sections 242A and 244A of the first and second intermediate beam members 242, 244 engaging the first upper thrust rollers 239 on the first stage weldment 230, and the lower second thrust rollers 249B engaging the web sections 232A and 234A of the first and second innermost beam members 232, 234, see FIGS. 7 and 21. The web sections 242A and 244A of the first and second intermediate beam members 242, 244 further function to transfer forces extending in a direction substantially perpendicular to the longitudinal centerline $CL_{100}$ of the vehicle power unit 102 from the second stage weldment 240 to the first upper thrust rollers 239 on the first stage weldment 230, while the lower second thrust rollers 249B further function to transfer forces extending in a direction substantially perpendicular to the longitudinal centerline $CL_{100}$ of the vehicle power unit 102 from the second stage weldment 240 to the web sections 232A and 234A of the first and second innermost beam members 232, 234, see FIGS. 7 and 21.

As the third stage weldment 250 moves relative to the second stage weldment 240, the third stage weldment 250 is maintained in proper position relative to the second stage weldment 240 in a direction substantially parallel to the longitudinal centerline $CL_{100}$ of the vehicle power unit 102 by the flange sections 252B, 252C and 254B, 254C of the first and second outermost beam members 252, 254 engaging the second upper column rollers 248A on the second stage weldment 240, and the lower column rollers 258 on the third stage weldment 250 engaging the flange sections 242B, 242C and 244B, 244C of the first and second intermediate beam members 242, 244, see FIGS. 6 and 21. The flange sections 252B, 252C and 254B, 254C of the first and second outermost beam members 252, 254 further function to transfer forces extending in a direction substantially parallel to the longitudinal centerline $CL_{100}$ of the vehicle power unit 102 from the third stage weldment 250 to the second upper column rollers 248A on the second stage weldment 240, while the lower column rollers 258 further function to transfer forces extending in a direction substantially parallel to the longitudinal centerline $CL_{100}$ of the vehicle power unit 102 from the third stage weldment 250 to the flange sections 242B, 242C and 244B, 244C on the second stage weldment 240.

Also as the third stage weldment 250 moves relative to the second stage weldment 240, the third stage weldment 250 is maintained in proper position relative to the second stage weldment 240 in a direction substantially perpendicular to the longitudinal centerline $CL_{100}$ of the vehicle power unit 102 by the web sections 252A and 254A of the first and second outermost beam members 252, 254 engaging the second upper thrust rollers 249A on the second stage weldment 240, and the lower thrust rollers 259 on the third stage weldment 250 engaging the web sections 242A and 244A of the first and second intermediate beam members 242, 244, see FIGS. 7 and 21. The web sections 252A and 254A of the first and second outermost beam members 252, 254 further function to transfer forces extending in a direction substantially perpendicular to the longitudinal centerline $CL_{100}$ of the vehicle power unit 102 from the third stage weldment 250 to the second upper thrust rollers 249A on the second stage weldment 240, while the lower thrust rollers 259 on the third stage weldment 250 further function to transfer forces extending in a direction substantially perpendicular to the longitudinal centerline $CL_{100}$ of the vehicle power unit 102 from the third stage weldment 250 to the web sections 242A and 244A of the first and second intermediate beam members 242, 244, see FIGS. 7 and 21.

The mast weldment lift structure 220 comprises a hydraulic ram/cylinder apparatus 222 comprising a cylinder 222A and a ram 222B, see FIGS. 7, 10, 20 and 21. The cylinder 222A is fixedly coupled to a base 1239 forming part of the first stage weldment 230, see FIGS. 5, 20 and 21. Hence, the cylinder 222A does not move vertically relative to the vehicle power unit 102. It is also noted that the cylinder 222A is generally centered within the first stage weldment 230, see FIGS. 5, 7, 20 and 21.

Figure 16:
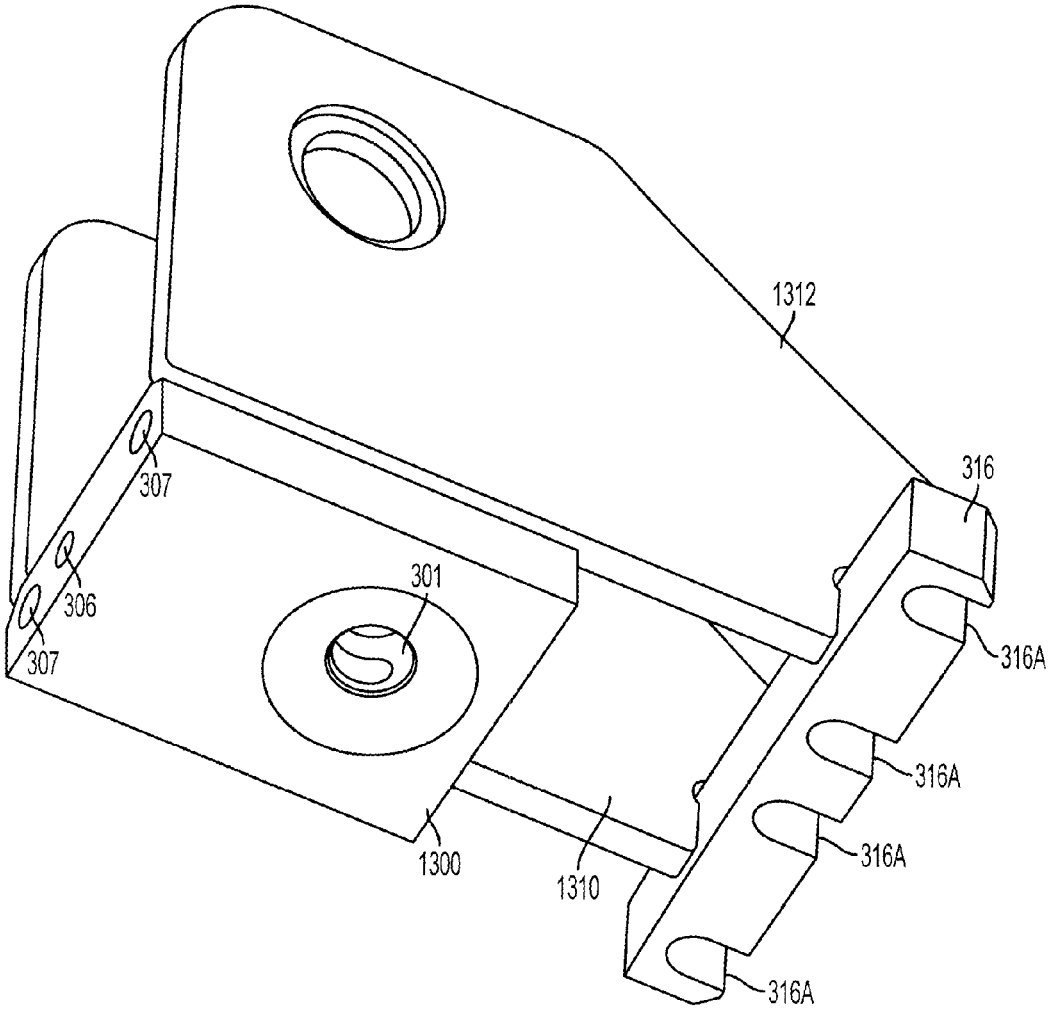
FIG. 16 is a perspective view of an engagement plate, first and second vertical plates and a tie member of a pulley assembly.

An engagement plate 1300 of a pulley assembly 302 is coupled to an end portion 1222B of the ram 222B, see FIG. 7. The engagement plate 1300 includes a first bore 301 for receiving the ram end portion 1222B, see FIGS. 7 and 16. A bolt or pin 304 is received in a second bore 306 in the plate 1300 to ensure that the ram end portion 1222B does not disengage from the plate 1300 in the event that the forks 402 and 404 get caught in, for example, a storage rack (not shown). The pulley assembly 302 further comprises first and second vertical plates 1310 and 1312, which are fixed to the engagement plate 1300 by welds. A pulley or roller 314 is received between and rotatably coupled to the first and second vertical plates 1310 and 1312, see FIGS. 7, 10 and 13. The pulley assembly 302 further comprises a tie member 316 which extends between and is fixedly connected to the first and second vertical plates 1310 and 1312 by welds, see FIG. 16. The pulley assembly 302 is fixedly coupled to the second stage weldment 240 by bolts 318 which pass through slots 316A in the tie member 316 and engage a bracket 340 fixedly coupled to the rear plate 247 of the second stage weldment 240, see FIGS. 13 and 16. The pulley assembly 302 is further coupled to the second stage weldment 240 by bolts 328, which pass through an intermediate plate 1330 fixedly coupled by welds to the front plate 246 of the second stage weldment 240 and threadedly engage bores 307 in the engagement plate 1300, see FIGS. 14 and 16.

Figure 10:
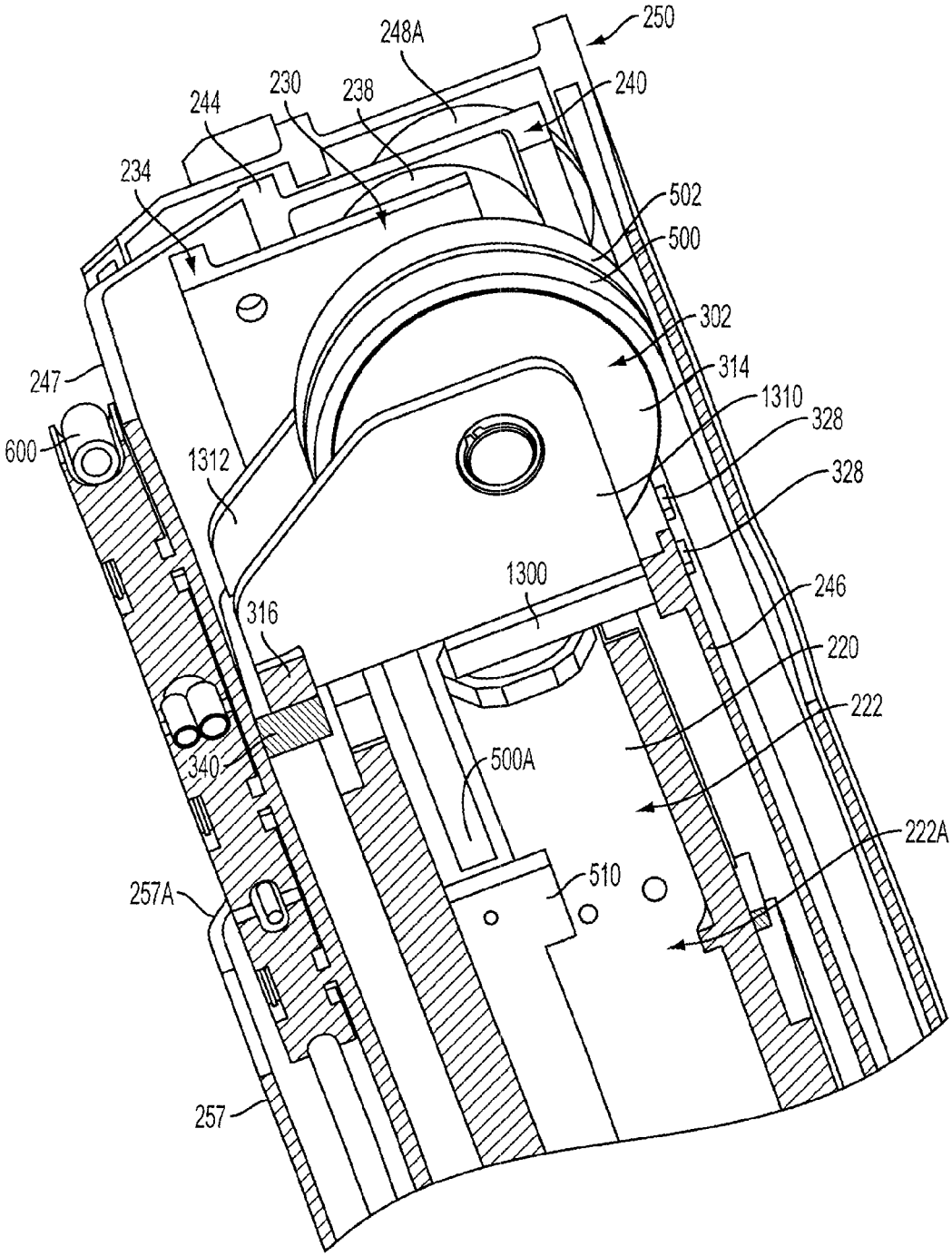
FIG. 10 is a perspective side view, partially in cross section, of the monomast upper portion.
Figure 22:
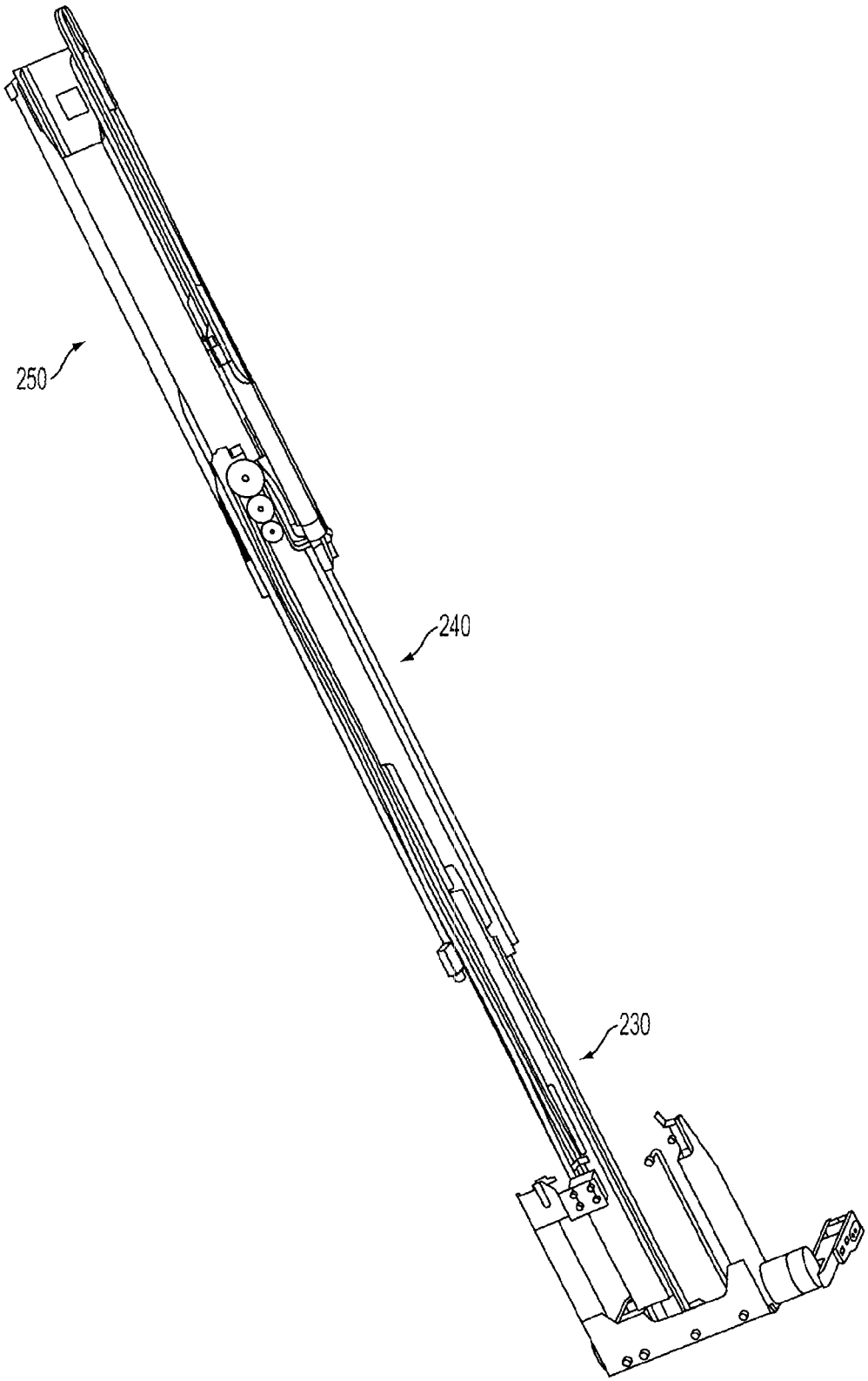
FIG. 22 is a perspective rear view illustrating the second and third stage weldments extended relative to the first stage weldment.

First and second chains 500 and 502 are coupled at first ends (only the first end 500A of the first chain 500 is clearly illustrated in FIGS. 10 and 20) to chain anchors (not shown) which, in turn, are bolted to a bracket 510 fixedly welded to the cylinder 222A of the hydraulic ram/cylinder apparatus 222, see FIGS. 10 and 20. Opposing second ends of the first and second chains 500 and 502 (only the second end 500B of the first chain 500 is clearly illustrated in FIG. 20) are coupled to a lower section 250A of the third stage weldment 250 via coupling anchors 504 and 506, see FIGS. 2 and 20. The first and second chains 500 and 502 extend over the pulley or roller 314 of the pulley assembly 302, see FIGS. 6, 7, 10 and 20. When the ram 222B is extended, it causes the pulley assembly 302 to move vertically upward such that the pulley 314 pushes upwardly against the first and second chains 500 and 502. As the pulley 314 applies upward forces on the chains 500 and 502, the second stage weldment 240 moves vertically relative to the first stage weldment 230 and the third stage weldment 250 moves vertically relative to the first and second stage weldments 230 and 240, see FIG. 22. For every one unit of vertical movement of the second stage weldment 240 relative to the first stage weldment 230, the third stage weldment 250 moves vertically two units relative to the first stage weldment 230.

Figure 23:
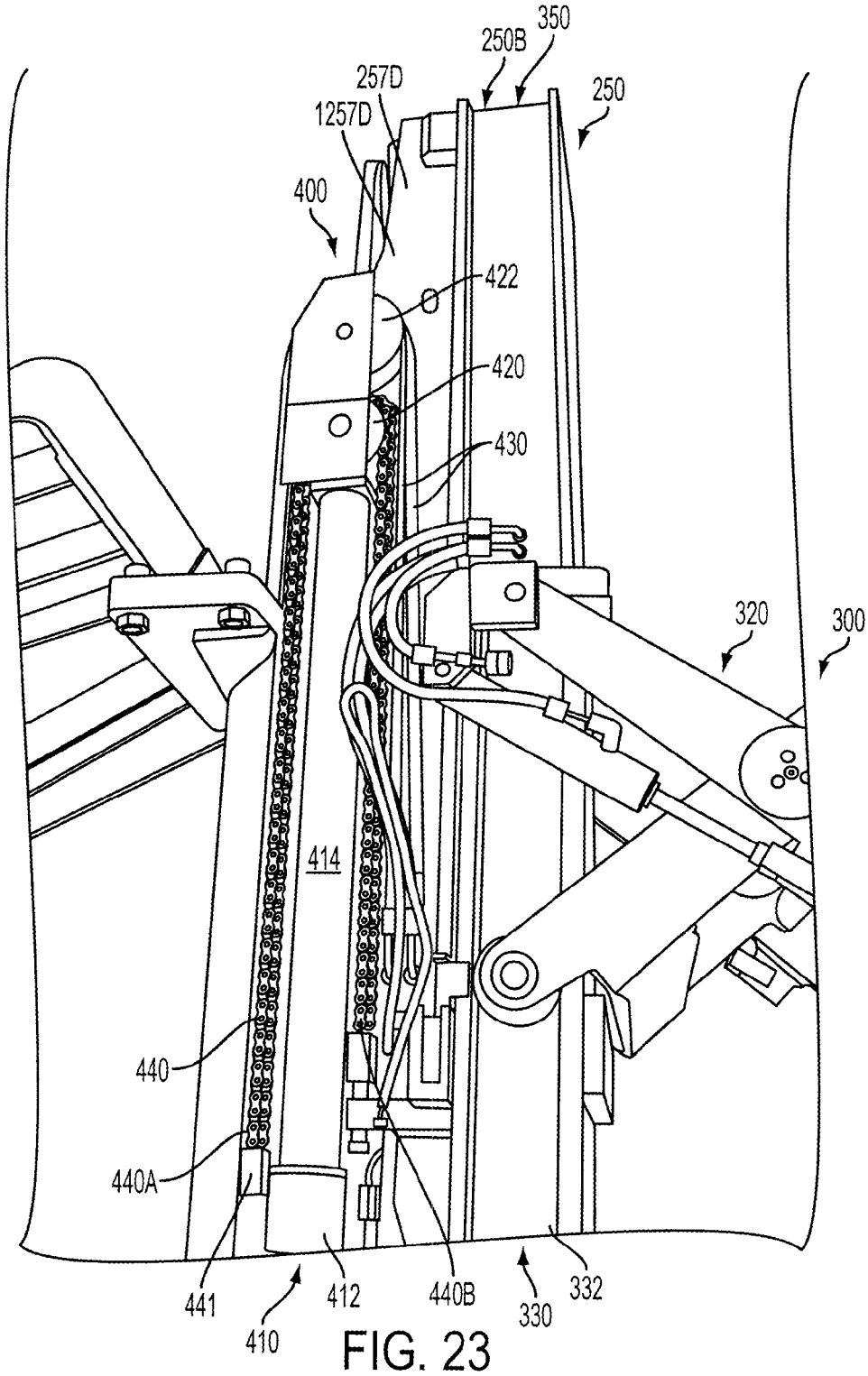
FIG. 23 is a perspective side view illustrating the monomast and a portion of the fork carriage apparatus.
Figure 24:
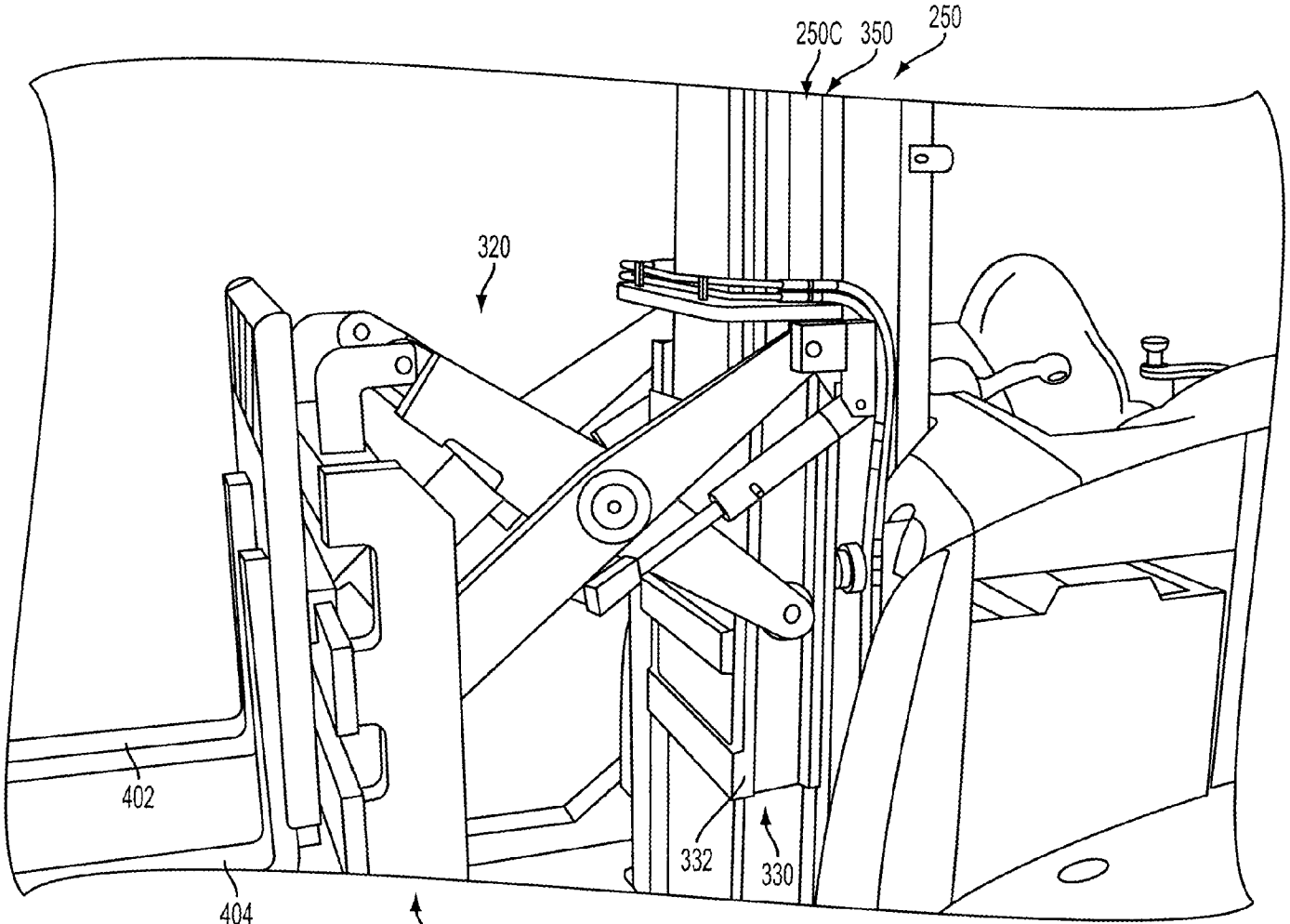
FIG. 24 is a perspective side view illustrating the fork carriage apparatus coupled to the monomast illustrated in FIG. 1.

The fork carriage apparatus 300 is coupled to the third stage weldment 250 so as to move vertically relative to the third stage weldment 250, see FIG. 23. The fork carriage apparatus 300 also moves vertically with the third stage weldment 250 relative to the first and second stage weldments 230 and 240. The fork carriage apparatus 300 comprises a fork carriage mechanism 310 to which the first and second forks 402 and 404 are mounted, see FIG. 24. The fork carriage mechanism 310 is mounted to a reach mechanism 320 which, in turn, is mounted to a mast carriage assembly 330, see FIGS. 23 and 24. The mast carriage assembly 330 comprises a main unit 332 having a plurality of rollers 334 which are received in tracks 350 formed in opposing outer sides surfaces 250B and 250C of the third stage weldment 250, see FIGS. 3, 23 and 24. The forks 402 and 404 may also be moved from side to side by a side shift mechanism and tilted via a tilt mechanism.

The fork carriage apparatus lift structure 400 comprises a hydraulic ram/cylinder apparatus 410 including a cylinder 412 and a ram 414, see FIG. 23. The cylinder 412 is fixedly coupled to a side section 257D of the third stage weldment rear plate 257 via first and second upper coupling elements 1257E and 1257F and first and second lower coupling elements 2257E and 2257F, see FIGS. 3, 17, 18, 25 and 26. The first upper coupling element 1257E is welded to the side section 257D of the third stage weldment rear plate 257, see FIGS. 3, 17 and 18. The second upper coupling element 1257F is welded to the cylinder 412, see FIGS. 25 and 26. The first upper coupling element 1257E and the second upper coupling element 1257F are bolted together via bolts 3257A, see FIGS. 25 and 26. The first lower coupling element 2257E is welded to the side section 257D of the third stage weldment rear plate 257, see FIGS. 17, 18 and 26. The second lower coupling element 2257F is welded to the cylinder 412, see FIG. 26. The first lower coupling element 2257E and the second lower coupling element 2257F are joined via pin 3257B, see FIG. 26.

The side section 257D of the third stage weldment rear plate 257 is near the longitudinal centerline $CL_{100}$ of the vehicle power unit 102. Hence, the cylinder 412 is mounted near the longitudinal centerline $CL_{100}$ of the vehicle power unit 102, see FIG. 2. It is contemplated that the cylinder 412 is positioned "near" the longitudinal centerline $CL_{100}$ of the vehicle power unit 102 if an extension of the longitudinal centerline $CL_{100}$ extends through the cylinder 412 or passes adjacent to and a short distance, e.g., less than about 3 inches, from an outer wall of the cylinder 412. The cylinder 412 is mounted to a rear portion 1257D of the side section 257D near an intersection 257F of the side section 257D and a back section 257G of the rear plate 257, see FIGS. 3 and 18.

First and second pulleys 420 and 422 are coupled to an upper end of the ram 414, see FIG. 23. A lift chain 440 extends over the first pulley 420 and is coupled at a first end 440A to the cylinder 412 via chain anchors and a bracket 441 welded to the cylinder 412 and at its second end 440B to the mast carriage assembly 330, see FIG. 23. Vertical movement of the ram 414 effects vertical movement of the entire fork carriage apparatus 300 relative to the third stage weldment 250. Supply and return hydraulic hoses 430 extend over the second pulley 422, see FIG. 23. The hydraulic hoses 430 define hydraulic fluid supply and return paths for the fork carriage apparatus 300. One or more electrical cables 431 may also extend over the second pulley 422 or a separate pulley, see FIG. 25. The one or more electrical cables 431 may control the operation of one or more electronically controlled valves forming part of the fork carriage apparatus 300.

Because the fork carriage apparatus lift structure 400 is positioned near the longitudinal centerline $CL_{100}$ of the vehicle power unit 102, side or thrust loads created in the monomast 200 as a result of a load provided on the forks 402 and 404 are minimized. It is also noted that because the cylinder 412 is coupled to the rear portion 1257D of the side section 257D of the third stage weldment rear plate 257, all or a substantial portion of the fork carriage apparatus lift structure 400 is located within the area defined by the view lines $VL_1$ and $VL_2$, which area, as noted above, represents a blocked viewing area for an operator. The blocked viewing area is defined by outermost points on the monomast 200 comprising an outer corner 1252B of the flange section 252B and the oblique side wall 257C of the third stage weldment 250, see FIGS. 3 and 19. Hence, the fork carriage apparatus lift structure 400 falls within an area already blocked by the structure forming part of the monomast 200, and, consequently, does not block any additional operator viewing area.

Figure 25:
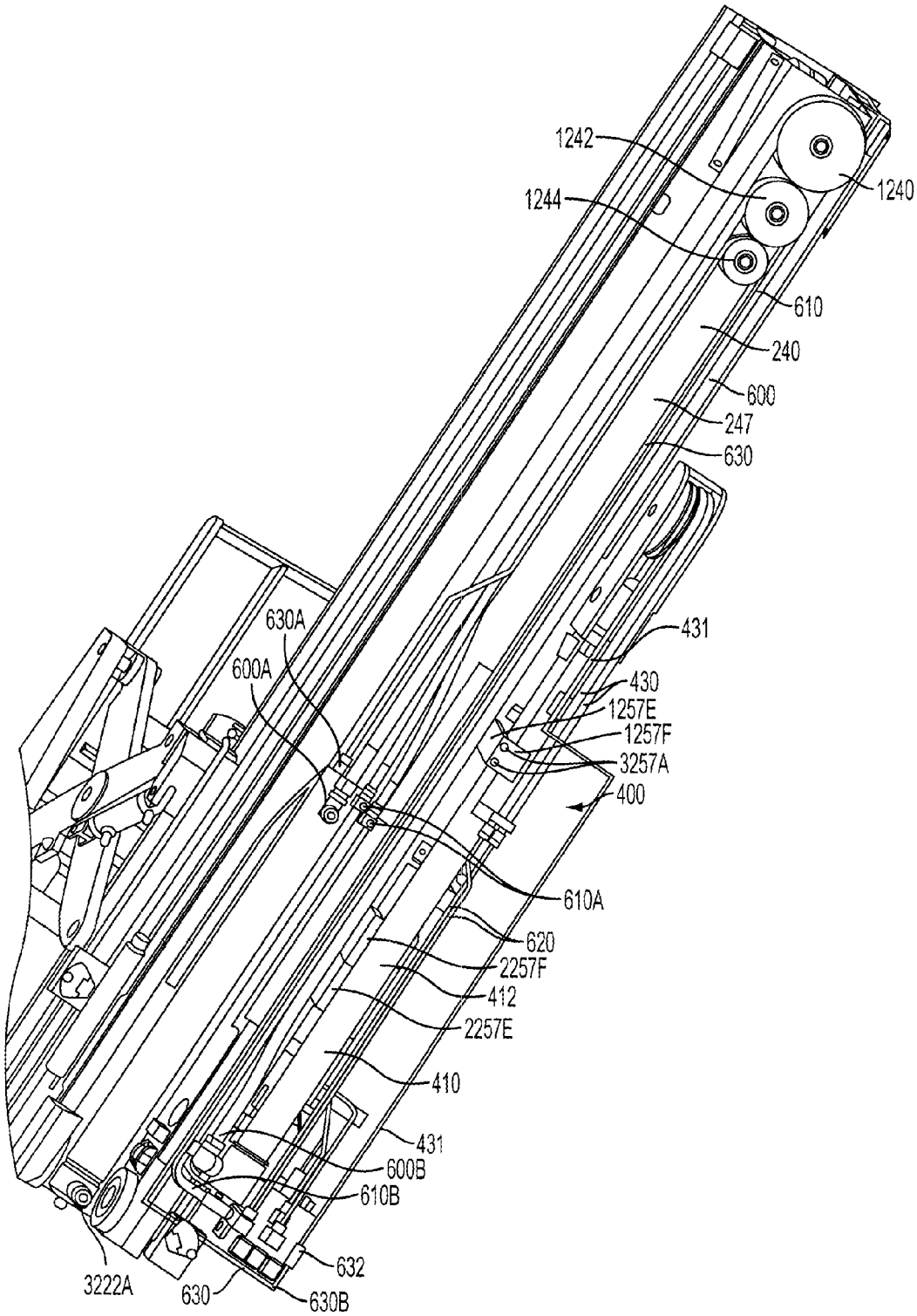
FIG. 25 is a perspective view of a rear portion of the monomast and fork carriage apparatus with a power unit of the vehicle and a third stage weldment removed.
Figure 26:
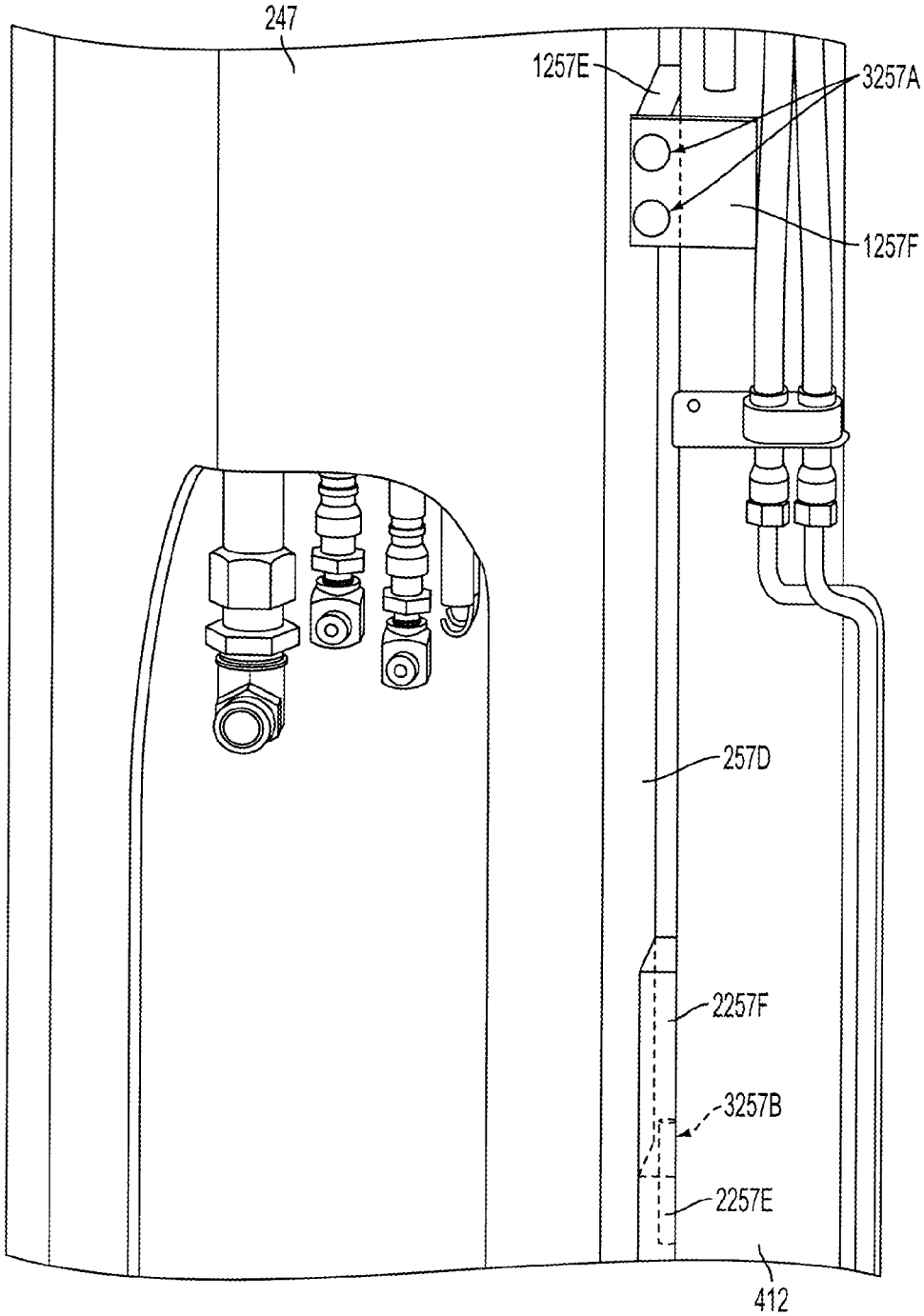
FIG. 26 is a rear view of the third stage weldment illustrating the cylinder of the fork carriage lift structure coupled to the third stage weldment rear plate.

A hydraulic hose 600 extends over the first pulley 1240 coupled to the rear plate 247 of the second stage weldment 240, see FIGS. 9 and 25 (the third stage weldment 250 is not illustrated in FIG. 25). The hose 600 is coupled at a first end 600A to a hydraulic supply source (not shown) on the vehicle power unit 102 and at a second end 600B to a base of the cylinder 412 of the fork carriage apparatus lift structure 400, see FIG. 25. The hydraulic supply source is also coupled to a fitting 3222A at the base of the cylinder 222A of the mast weldment lift structure 220. When a lift command is generated by an operator via the multifunction controller 130, both the cylinder 412 of the fork carriage apparatus lift structure 400 and the cylinder 222A of the mast weldment lift structure 220 are exposed to hydraulic fluid at the same pressure. Because the ram 414 of the fork carriage apparatus lift structure 400 and the ram 222B of the mast weldment lift structure 220 include base ends having substantially the same cross sectional areas and for all load conditions, the fork carriage apparatus lift structure 400 requires less pressure to actuate than the mast weldment lift structure 220, the ram 414 of the fork carriage apparatus lift structure 400 will move first until the fork carriage apparatus 300 has reached its maximum height relative to the third stage weldment 250. Thereafter, the second and third stage weldments 240 and 250 will begin to move vertically relative to the first stage weldment 230.

First and second hydraulic supply and return hoses 610 extend over the second pulley 1242 coupled to the rear plate 247 of the second stage weldment 240, see FIGS. 9 and 25. First ends 610A of the hydraulic hoses 610 are coupled to appropriate hydraulic fluid supply and return structure provided on the vehicle power unit 102 and second ends 610B of the hydraulic hoses 610 are coupled to metal lines 620, which, in turn, are coupled to the hydraulic hoses 430 discussed above.

One or more electrical cables 630 extend over the third pulley 1244 coupled to the rear plate 247 of the second stage weldment 240, see FIGS. 9 and 25 where only a single cable 630 is illustrated. A first end 630A of each cable 630 is coupled to communication structure (not shown) provided on the vehicle power unit 102 and a second end 630B of each cable 630 may be connected to coupling structure 632 which, in turn, is coupled to a corresponding electrical cable 431, discussed above.

Figure 27:
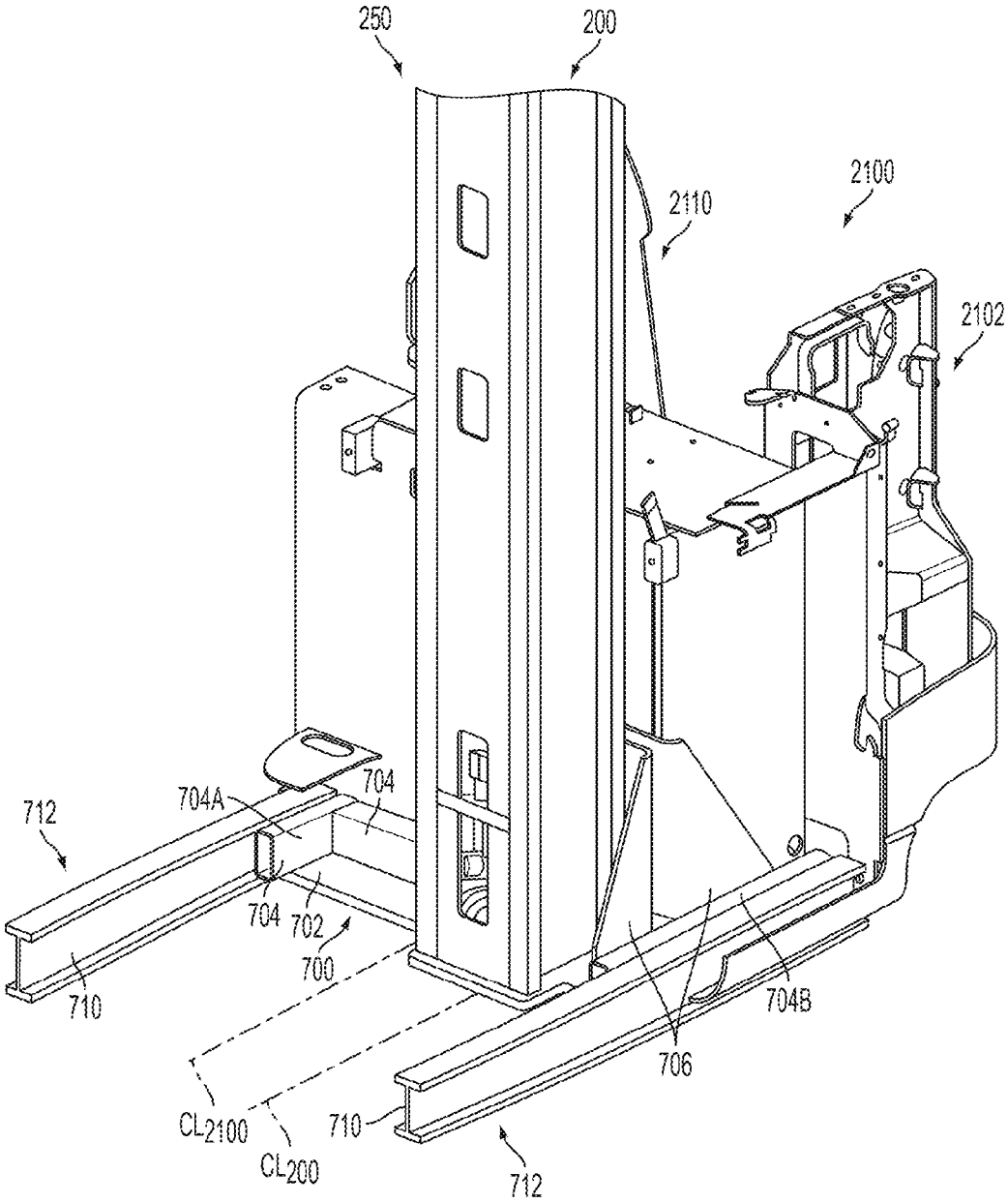
FIG. 27 is a perspective view of a monomast coupled to a reach carriage which, in turn, is coupled to a power unit of a vehicle constructed in accordance with a second embodiment of the present invention.
Figure 28:
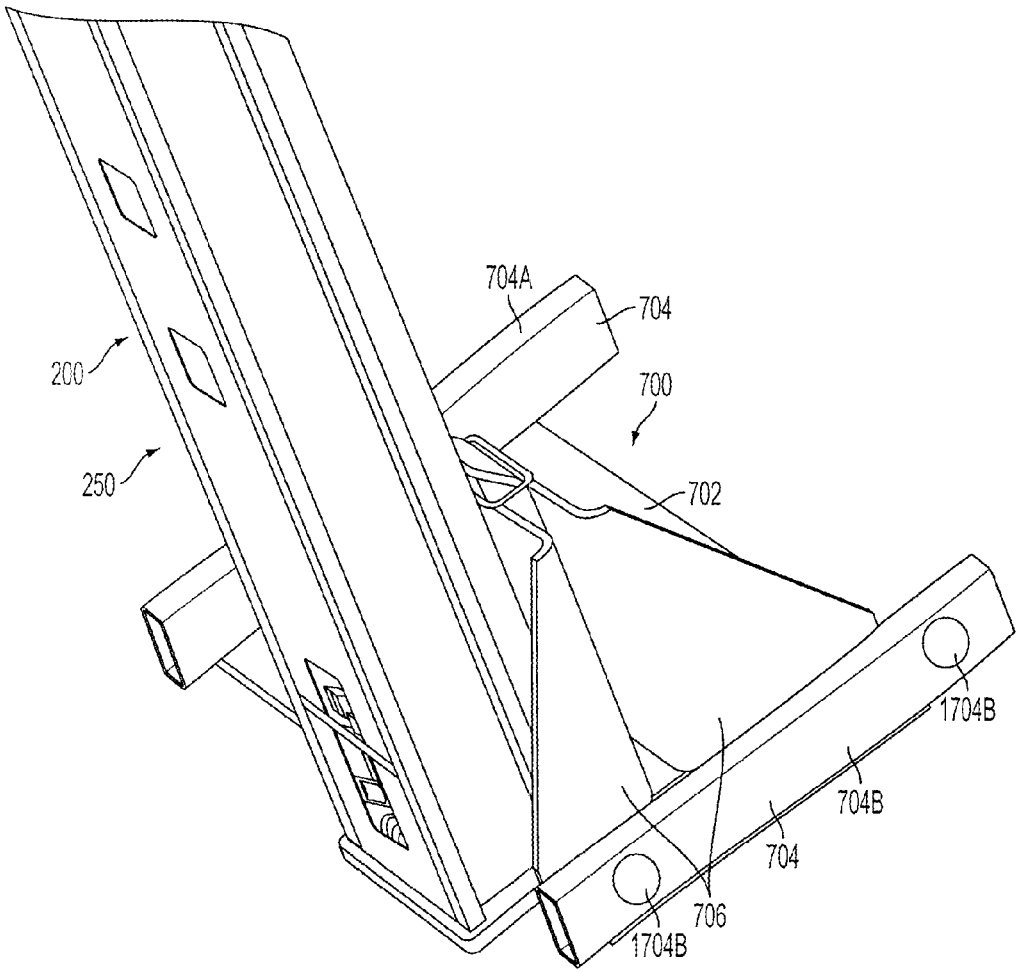
FIG. 28 is a front/side view of the monomast and reach carriage illustrated in FIG. 27.

In accordance with an alternative embodiment of the present invention, as illustrated in FIGS. 27 and 28, wherein like reference numerals indicate like elements, a monomast 200, constructed in generally the same manner as the monomast 200 illustrated in FIG. 2, is fixedly coupled to a reach carriage 700. A fork carriage apparatus (not shown) is coupled to the monomast 200 shown in FIG. 27. A fork carriage apparatus lift structure (not shown) is provided, which may be constructed in the same manner as the fork carriage apparatus lift structure 400 shown in FIG. 23.

The reach carriage 700 comprises a base member 702, a base frame 704 to which the base member 702 is welded, and a substantially vertical support bracket 706. The monomast 200 comprises a first stage weldment (not shown), a second stage weldment (not shown) positioned to telescope over the first stage weldment and a third stage weldment 250 positioned to telescope over the first and second stage weldments. The first stage weldment is bolted to the top and bottom of the vertical support bracket 706 so as to be fixedly coupled to the reach carriage 700 at two vertically spaced locations. First and second frame members 704A and 704B of the base frame 704 are provided with rollers (only rollers 1704B on the second frame member 704B are illustrated in FIG. 28), which are received in tracks 710 defined in outriggers 712, shown only as I-beams. Support wheels (not shown), similar to the support wheels 202A and 204A provided on the outriggers 202 and 204 in FIG. 1, are coupled to the I-beams. The outriggers 712 are fixedly coupled to a vehicle power unit 2102, shown only as a frame in FIG. 27. The reach carriage 700 and, hence, the monomast 200, the fork carriage apparatus and the fork carriage apparatus lift structure, are capable of reciprocating movement toward and away from the power unit 2102 via a hydraulic cylinder (not shown) coupled to the reach carriage 700 and the power unit 2102 and the rollers on the first and second frame members 704A and 704B moving within the tracks 710 provided in the outriggers 712.

The fork carriage apparatus comprises a mast carriage assembly (not shown) which is vertically movable along the third stage weldment 250 via the fork carriage apparatus lift structure. The mast carriage assembly may be constructed in a manner similar to the mast carriage assembly 330 shown in FIG. 23. The fork carriage apparatus further comprises a fork carriage mechanism (not shown) to which first and second forks (not shown) are coupled. The fork carriage mechanism may be constructed in a manner similar to the fork carriage mechanism 310 illustrated in FIG. 24, but instead of being coupled to a reach mechanism, the fork carriage mechanism is coupled directly to the mast carriage assembly for vertical movement with the mast carriage assembly. Hence, in the FIG. 27 embodiment, the fork carriage apparatus does not include a reach mechanism.

The vehicle power unit 2102 includes a longitudinal centerline $CL_{2100}$, see FIG. 27. The power unit 2102 houses a battery (not shown) for supplying power to a traction motor coupled to a steerable wheel (not shown) mounted near a first corner at the rear of the power unit 2102. Mounted to a second corner at the rear of the power unit 2102 is a caster wheel (not shown). It is also contemplated that instead of using a steerable drive wheel mounted near the first corner at the rear of the power unit and a caster wheel mounted to a second corner at the rear of the power unit a single drive unit may be provided and positioned so as to be near the center at the rear of the power unit. The battery also supplies power to a motor (not shown), which drives a hydraulic pump (not shown). The pump supplies pressurized hydraulic fluid to the fork carriage apparatus lift structure and a mast weldment lift structure (not shown). The mast weldment lift structure may be constructed in the same manner as the mast weldment lift structure 220 shown in FIG. 7. The vehicle power unit 2102, the monomast 200, the fork carriage apparatus, the fork carriage apparatus lift structure and the reach carriage 700 define a materials handling vehicle 2100, such as a rider reach truck.

The vehicle power unit 2102 includes an operator's compartment 2110, which, in the illustrated embodiment, is positioned on a side of the longitudinal centerline $CL_{2100}$ of the vehicle power unit 2102 opposite a side where the monomast 200 is positioned, see FIG. 27. An operator standing in the compartment 2110 may control the direction of travel of the truck 2100 via a tiller (not shown). The operator may also control the travel speed of the truck 2100, and height, extension, tilt and side shift of the first and second forks via a multifunction controller (not shown). Hence, when the forks need to be extended horizontally in a direction away from the vehicle power unit 2102, in response to an appropriate operator generated command via the multifunction controller, the reach mechanism and, hence, the monomast 200 and the fork carriage apparatus, are moved away from the power unit 2102 via the hydraulic cylinder and the rollers on the first and second frame members 704A and 704B moving within the tracks 710 provided in the outriggers 712. When the forks need to be extended horizontally in a direction toward the vehicle power unit 2102, in response to an appropriate operator generated command via the multifunction controller, the reach mechanism and, hence, the monomast 200 and the fork carriage apparatus, are moved toward the power unit 2102 via the hydraulic cylinder and the rollers on the first and second frame members 704A and 704B moving within the tracks 710 provided in the outriggers 712.

The monomast 200 has a longitudinal centerline $CL_{200}$, see FIG. 27. As is apparent from FIG. 27, the monomast longitudinal centerline $CL_{200}$ is offset from, i.e., spaced laterally from, the longitudinal centerline $CL_{2100}$ of the vehicle power unit 2102. Further, the monomast longitudinal centerline $CL_{200}$ is substantially parallel with the longitudinal centerline $CL_{2100}$ of the vehicle power unit 2102.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A materials handling vehicle comprising:

a vehicle power unit having a longitudinal centerline;

a monomast coupled to said vehicle power unit and having a centerline offset from and generally parallel with said longitudinal centerline of said vehicle power unit, said monomost comprising:

a first stage weldment coupled to said vehicle power unit;

a second stage weldment positioned to telescope over said first stage weldment;

a third stage weldment positioned to telescope over and surround, when retracted, said first and second stage weldments; and a mast weldment lift structure for effecting lifting movement of said second and third stage weldments relative to said first stage weldment;

a fork carriage apparatus movably coupled to said monomast, said fork carriage apparatus being movably coupled to said third stage weldment; and fork carriage apparatus lift structure for effecting lifting movement of said fork carriage apparatus relative to said third stage weldment and being located outside of said third stage weldment, at least a substantial portion of said fork carriage apparatus lift structure falling within a blocked viewing area for an operator so as not to block any additional operator viewing area.

2. The materials handling vehicle as set out in claim 1, wherein said first stage weldment comprises at least one innermost beam member having a first web section extending generally parallel to said monomast centerline and a first thrust roller coupled to said first web section and having an axis of rotation extending generally parallel to said monomast centerline;

said second stage weldment comprises at least one intermediate beam member having a second web section extending generally parallel to said monomast centerline and a second thrust roller coupled to said second web section and having an axis of rotation extending generally parallel to said monomast centerline, said first thrust roller being capable of engaging said second web section; and said third stage weldment comprises at least one outermost beam member having a third web section extending generally parallel to said monomast centerline and a third thrust roller coupled to said third web section and having an axis of rotation extending generally parallel to said monomast centerline, said second thrust roller being capable of engaging said third web section and said third thrust roller being capable of engaging said second web section.

3. The materials handling vehicle as set out in claim 2, wherein said innermost beam member of said first stage weldment further comprises a first flange section coupled and generally transverse to said first web section;

said intermediate beam member of said second stage weldment further comprises a second flange section coupled and generally transverse to said second web section;

said outermost beam member of said third stage weldment further comprises a third flange section coupled and generally transverse to said third web section;

said first stage weldment further comprises a first column roller coupled to said first web section of said innermost beam member and having an axis of rotation extending generally transverse to said monomast centerline, said first column roller being capable of engaging with said second flange section;

said second stage weldment further comprises a second column roller coupled to said second web section of said intermediate beam member and having an axis of rotation extending generally transverse to said monomast centerline, said second column roller being capable of engaging with said third flange section; and said third stage weldment further comprises a third column roller coupled to said third web section of said outermost beam member and having an axis of rotation extending generally transverse to said monomast centerline, said third column roller being capable of engaging with said second flange section.

4. The materials handling vehicle as set out in claim 2, wherein said vehicle power unit comprises an operator compartment positioned on a side of said longitudinal centerline of said vehicle power unit opposite a side where said monomast is positioned;

said at least one outermost beam member of said third stage weldment comprises first and second outermost beam members; and said third stage weldment further comprises first and second plates extending between and coupled to said first and second outermost beam members, said first plate having an oblique side wall to expand a field of view of an operator positioned in said operator compartment.

5. The materials handling vehicle as set out in claim 2, wherein said at least one intermediate beam member of said second stage weldment comprises first and second intermediate beam members; and said second stage weldment further comprises first and second plates extending between and coupled to said first and second intermediate beam members and two or more pulleys vertically spaced apart from one another and coupled to said first plate of said second stage weldment.

6. The materials handling vehicle as set out in claim 2, wherein said at least one innermost beam member of said first stage weldment comprises first and second innermost beam members; and said first stage weldment further comprises first and second plates extending between and coupled to said first and second innermost beam members, a thickness of at least one of said first and second plates coupled to said first and second innermost beam members being variable as a function of at least one of maximum lift height of said third stage weldment and maximum vehicle load capacity.

7. The materials handling vehicle as set out in claim 1, wherein said fork carriage apparatus lift structure comprises a first ram/cylinder apparatus comprising a cylinder fixed to said third stage weldment and positioned near said vehicle power unit longitudinal centerline.

8. The materials handling vehicle as set out in claim 1, wherein said mast weldment lift structure comprises a second ram/cylinder apparatus comprising a cylinder positioned within and coupled to said first stage weldment.

9. The materials handling vehicle as set out in claim 1, wherein said first stage weldment is coupled to said vehicle power unit at two vertically spaced apart locations.

10. The materials handling vehicle as set out in claim 1, wherein said first stage weldment is fixedly coupled to said vehicle power unit.

11. The materials handling vehicle as set out in claim 1, wherein said first stage weldment is coupled to said vehicle power unit so as to reciprocate back and forth relative to said power unit.

12. A materials handling vehicle comprising:

a vehicle power unit having a longitudinal centerline;

a monomast coupled to said vehicle power unit and having a centerline offset from said longitudinal centerline of said vehicle power unit, said monomast comprising a first stage weldment coupled to said vehicle power unit, a second stage weldment positioned to telescope over said first stage weldment, a third stage weldment positioned to telescope over and surround, when retracted, said first and second stage weldments, and a mast weldment lift structure for effecting lifting movement of said second and third weldments relative to said first weldment;

a fork carriage apparatus movably coupled to said third stage weldment; and fork carriage apparatus lift structure for effecting lifting movement of said fork carriage apparatus relative to said third stage weldment, said fork carriage apparatus lift structure comprising a first ram/cylinder apparatus comprising a cylinder mounted to an outer surface of said third stage weldment and positioned near said vehicle power unit longitudinal centerline.

13. The materials handling vehicle as set out in claim 12, wherein said first stage weldment comprises at least one innermost beam member having a first web section extending generally parallel to said monomast centerline and a first thrust roller coupled to said first web section and having an axis of rotation extending generally parallel to said monomast centerline;

said second stage weldment comprises at least one intermediate beam member having a second web section extending generally parallel to said monomast centerline and a second thrust roller coupled to said second web section and having an axis of rotation extending generally parallel to said monomast centerline, said first thrust roller being capable of engaging said second web section; and said third stage weldment comprises at least one outermost beam member having a third web section extending generally parallel to said monomast centerline and a third thrust roller coupled to said third web section and having an axis of rotation extending generally parallel to said monomast centerline, said second thrust roller being capable of engaging said third web section and said third thrust roller being capable of engaging said second web section.

14. The materials handling vehicle as set out in claim 13, wherein said innermost beam member of said first stage weldment further comprises a first flange section coupled and generally transverse to said first web section;

said intermediate beam member of said second stage weldment further comprises a second flange section coupled and generally transverse to said second web section;

said outermost beam member of said third stage weldment further comprises a third flange section coupled and generally transverse to said third web section;

said first stage weldment further comprises a first column roller coupled to said first web section of said innermost beam member and having an axis of rotation extending generally transverse to said monomast centerline, said first column roller being capable of engaging with said second flange section;

said second stage weldment further comprises a second column roller coupled to said second web section of said intermediate beam member and having an axis of rotation extending generally transverse to said monomast centerline, said second column roller being capable of engaging with said third flange section; and said third stage weldment further comprises a third column roller coupled to said third web section of said outermost beam member and having an axis of rotation extending generally transverse to said monomast centerline, said third column roller being capable of engaging with said second flange section.

15. The materials handling vehicle as set out in claim 13, wherein said vehicle power unit comprises an operator compartment positioned on a side of said longitudinal centerline of said vehicle power unit opposite a side where said monomast is positioned;

said at least one outermost beam member of said third stage weldment comprises first and second outermost beam members; and said third stage weldment further comprises first and second plates extending between and coupled to said first and second outermost beam members, said first plate having an oblique side wall to expand a field of view of an operator positioned in said operator compartment.

16. The materials handling vehicle as set out in claim 13, wherein said at least one intermediate beam member of said second stage weldment comprises first and second intermediate beam members; and said second stage weldment further comprises first and second plates extending between and coupled to said first and second intermediate beam members and two or more pulleys vertically spaced apart from one another and coupled to said first plate of said second stage weldment.

17. The materials handling vehicle as set out in claim 13, wherein said at least one innermost beam member of said first stage weldment comprises first and second innermost beam members; and said first stage weldment further comprises first and second plates extending between and coupled to said first and second innermost beam members, a thickness of at least one of said first and second plates coupled to said first and second innermost beam members being variable as a function of at least one of a maximum lift height of said third stage weldment and maximum vehicle load capacity.

18. The materials handling vehicle as set out in claim 12, wherein said mast weldment lift structure comprises a second ram/cylinder apparatus comprising a cylinder positioned within and coupled to said first stage weldment.

19. The materials handling vehicle as set out in claim 12, wherein said first stage weldment is coupled to said vehicle power unit at two vertically spaced apart locations.

* * * * *